US008097096B2

(12) United States Patent
Yoshida et al.

(10) Patent No.: US 8,097,096 B2
(45) Date of Patent: Jan. 17, 2012

(54) FIRE RESISTANT STEEL EXCELLENT IN HIGH TEMPERATURE STRENGTH, TOUGHNESS, AND REHEATING EMBRITTLEMENT RESISTANCE AND PROCESS FOR PRODUCTION OF THE SAME

(75) Inventors: Suguru Yoshida, Tokyo (JP); Kita Hiroshi, Tokyo (JP); Hirokazu Sugiyama, Tokyo (JP); Yoshiyuki Watanabe, Tokyo (JP); Yasushi Hasegawa, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 408 days.

(21) Appl. No.: 12/439,776

(22) PCT Filed: Jul. 30, 2007

(86) PCT No.: PCT/JP2007/065308

§ 371 (c)(1),
(2), (4) Date: Mar. 3, 2009

(87) PCT Pub. No.: WO2008/029583

PCT Pub. Date: Mar. 13, 2008

(65) Prior Publication Data

US 2010/0065168 A1 Mar. 18, 2010

(30) Foreign Application Priority Data

Sep. 4, 2006 (JP) ..... 2006-238973
Jul. 17, 2007 (JP) ..... 2007-186004

(51) Int. Cl.

| | |
|---|---|
| ***C22C 38/14*** | (2006.01) |
| ***C22C 38/12*** | (2006.01) |
| ***C21D 8/00*** | (2006.01) |
| ***C21D 7/13*** | (2006.01) |

(52) U.S. Cl. ..... 148/320; 148/328; 148/331; 148/332; 148/333; 148/334; 148/335; 148/644; 148/648; 148/654; 420/126; 420/127; 420/128; 420/109; 420/110

(58) Field of Classification Search ..... 148/320, 148/328, 331–336, 644, 648, 654; 420/126–128, 420/109, 110

See application file for complete search history.

(56) References Cited

U.S. PATENT DOCUMENTS 5,147,474 A * 9/1992 Tamehiro et al. ..... 148/320

(Continued)

FOREIGN PATENT DOCUMENTS

EP 1 026 275 A1 8/2000

(Continued)

OTHER PUBLICATIONS

Extended European Search Report, dated Dec. 16, 2010, for European Application No. 07791981.9.

*Primary Examiner* — Deborah Yee

(74) *Attorney, Agent, or Firm* — Birch, Stewart, Kolasch & Birch LLP

(57) ABSTRACT

The present invention provides a fire resistant steel material excellent in high temperature strength, toughness, and reheating embrittlement resistance containing, by mass %, C: 0.001% to 0.030%, Si: 0.05% to 0.50%, Mn: 0.4% to 2.0%, Nb: 0.03% to 0.50%, Ti: 0.005% to less than 0.040%, N: 0.0001% to less than 0.0050%, and Al: 0.005% to 0.030%, limiting P: 0.03% or, less and S: 0.02% or less, satisfying C—Nb/7.74≦0.005 and 2≦Ti/N≦12, and having a balance of Fe and unavoidable impurities and, further, a process for production of a fire resistant material comprising heating a steel slab comprised of this chemical composition to 1100 to 1350° C. and hot rolling it by a cumulative reduction rate at 1000° C. or less of 30% or more.

12 Claims, 5 Drawing Sheets

U.S. PATENT DOCUMENTS

| | | | |
|---|---|---|---|
| 6,245,290 | B1 | 6/2001 | Koo et al. |
| 2009/0087335 | A1 | 4/2009 | Okumura et al. |

FOREIGN PATENT DOCUMENTS

| | | | |
|---|---|---|---|
| EP | 1 462 535 | A1 | 9/2004 |
| JP | 5-222484 | A | 8/1993 |
| JP | 9-176730 | A | 7/1997 |
| JP | 10-176237 | A | 6/1998 |
| JP | 2000-54061 | A | 2/2000 |
| JP | 2002-115022 | A | 4/2002 |
| JP | 2002-173734 | A | 6/2002 |
| JP | 2005-281838 | A | 10/2005 |
| JP | 2006-2198 | A | 1/2006 |
| WO | WO 98/38345 | A1 | 9/1998 |
| WO | 2006/118339 | A1 | 11/2006 |

* cited by examiner (a)

(b)

FIRE RESISTANT STEEL EXCELLENT IN HIGH TEMPERATURE STRENGTH, TOUGHNESS, AND REHEATING EMBRITTLEMENT RESISTANCE AND PROCESS FOR PRODUCTION OF THE SAME

TECHNICAL FIELD

The present invention relates to a fire resistant steel material excellent in high temperature strength, toughness, and reheating embrittlement resistance used for a building structural member etc. and a process for production of the same.

BACKGROUND ART

Due to the increasing larger number of stories of buildings, the greater sophistication of building design technology, etc., fire-resistant designs were reevaluated in Japan as a project of the Ministry of Construction. The "New Fire-Resistant Design Law" was enacted in March 1987 as a result. Due to this, the limitation on fire-resistant coverings requiring that the temperature of the steel materials at the time of fires be kept to no more than 350° C. was reassessed. It became possible to select the suitable method of fire-resistant covering from the relationship between the high temperature strength of the steel material and the actual load of the building. For this reason, when it is possible to secure a high temperature strength satisfying the design standard of 600° C., that is, by using a steel material with a high temperature strength of 600° C., it became possible to simplify or reduce the fire-resistant covering.

To deal with this trend, steel materials for building use having a predetermined strength even when the building becomes on fire etc. and becomes a high temperature, which is so-called fire-resistant steel, is being developed. Here, fire-resistant steel envisioning a temperature of the building at the time of a fire of 600° C. and able to maintain strength at that temperature will be discussed.

As the strengthening mechanisms for obtaining high temperature strength at 600° C. of steel materials, the four types of mechanisms of (1) increased fineness of the crystal grain size of the ferrite, (2) dispersion strengthening by a hard phase, (3) precipitation strengthening by fine precipitates, and (4) solid-solution strengthening by alloy elements are well known.

(1) Increased fineness of crystal grain size of ferrite: Dislocations moving in the grains move to adjoining crystal grains through the crystal grain boundaries (below, also called the "grain boundaries"), so the crystal grain boundaries act as resistance to movement of dislocations. Therefore, if the crystal grains become fine, the frequency of the dislocations crossing the crystal grain boundaries when moving becomes higher and the resistance to movement of dislocations increases. The strengthening method using the increased fineness of the ferrite crystal grains to increase the resistance to movement of dislocations drops in effect due to grain growth at a high temperature. For this reason, in fire-resistant steel, the strengthening method using the increased fineness of the ferrite crystal grains is seldom used alone.

(2) Dispersion strengthening by hard phase: In a hard phase, compared with a soft phase, dislocations have a hard time moving in the crystal grains and the resistance required for deformation is large. Therefore, in a macro structure comprised of a hard phase and soft phase mixed together (called a "double phase structure"), the increase in the volume percentage of the hard phase causes a rise in strength. For example, in a double phase structure comprised of ferrite and pearlite, if the volume percentage of the hard phase of pearlite rises, the strength increases. However, this method has the problem of an easy drop of toughness due to the hard phase.

(3) Precipitation strengthening by fine precipitates: Precipitates distributed on the sliding surfaces act as resistance to movement of dislocations in the crystal grains. In particular, fine precipitates are effective in strengthening at a high temperature, so conventional fire-resistant steels often utilize this precipitation strengthening. In particular, in conventional fire-resistant steels, Mo is added to cause the formation of fine Mo carbides and improve the high temperature strength by precipitation strengthening (for example, see Japanese Patent Publication (A) No. 5-186847, Japanese Patent Publication (A) No 7-300618, Japanese Patent Publication (A) No. 9-241789, and Japanese Patent Publication (A) No. 2005-272854). In these conventional fire-resistant steels, the amount of C is made about 0.1% and Mo is made to precipitate as Mo carbides without becoming solid-solute. In addition, a steel material utilizing the fine precipitation of Cu to improve the high temperature strength has also been proposed (for example, see Japanese Patent Publication (A) No. 2002-115022).

However, in precipitation strengthening, in general, the problem is known that the base material falls in toughness and the weld heat affected zone at the time of welding (called the "HAZ") also falls in toughness due to the precipitates coarsened by the effect of the heating.

(4) Solid-solution strengthening by alloy elements: The alloy elements solid-solute in the steel (called "solid solution alloy elements") have elastic stress sites formed around them, so are dragged by dislocations and become resistances to movement of the dislocations. This is referred to as "drag resistance". Its magnitude is affected by the misfit of the solid solution alloy elements and the steel, that is, the difference in sizes of the solute atoms and solvent atoms, the concentration and diffusion coefficient of the solute atoms, etc. Note that the effect of solid solution alloy elements being dragged by dislocations and generating drag resistance is referred to as the "drag effect".

Solid-solution strengthening utilizing this drag effect is starting to be studied as a strengthening mechanism of fire-resistant steel. To utilize this solid-solution strengthening, it is necessary to reduce the carbon, nitrogen, etc. and inhibit the formation of carbides, nitrides, and other precipitates. For example, Japanese Patent Publication (A) No. 2006-249467 proposes a fire resistant steel material utilizing Mo as a solid solution alloy element. In this fire resistant steel material, Mo and B (boron) are included to raise the hardenability, while the upper limit of Mn is made 0.5% or lower than the general amount of addition to avoid excessive rise in strength.

Further, fire-resistant steel is also being proposed by Japanese Patent Publication (A) No. 5-222484, Japanese Patent Publication (A) No. 10-176237, Japanese Patent Publication (A) No. 2000-54061, Japanese Patent Publication (A) No. 2000-248335, Japanese Patent Publication (A) No. 2000-282167, etc. However, the fire-resistant steels in these references cover hot rolled steel plates with thin plate thicknesses etc. and do not consider the toughness of the base material and weld heat affected zone and the high temperature ductility of the weld heat affected zone required in thick-gauge steel plates, H-beams, and other thick-gauge steel materials. For this reason, there are the problems that:

a) To inhibit the precipitation of nitrides of Nb, Ti is added in excess. In thick-gauge steel materials, coarse Ti precipitates are formed and the toughness of the base material and weld heat affected zone cannot be secured, b) Al is added in excess for deoxidation, so in thick-gauge steel materials, the drop in toughness due to island-shaped martensite becomes a problem, c) B (boron) is sometimes included, so measures cannot be taken against the drop in high temperature ductility of the weld heat affected zone, that is, reheating embrittlement, etc.

DISCLOSURE OF THE INVENTION

To utilize steel shapes or thick-gauge steel plate or other thick-gauge steel materials as fire resistant steel materials, strict limitations are sought on the toughness, reheating embrittlement and other properties of the base material and weld heat affected zone. However, fire resistant steel materials utilizing conventional solid-solution strengthening do not consider application to such thick-gauge steel materials.

Further, Mo is unstable in price. The skyrocketing price of Mo in recent years has become a problem. Due to this, fire resistant steel material in which a large amount of Mo has been added as a strengthening element has begun to lose price competitiveness.

For this reason, the inventors engaged in intensive research on fire resistant steel materials using Nb as a solid solution element and its method of production. As a result, they discovered that there were the following issues in using thick-gauge steel materials using Nb as a solid-solution strengthening element for fire-resistant steel:

The first issue is the toughness. If the thickness of the steel plate is 7 mm or more, further 12 mm or more, when the amounts of addition of Ti and Al are outside the predetermined ranges, the toughness remarkably drops. In particular, in H-beams with a web thickness of 7 mm or more and a flange thickness of 12 mm or more, there is not the same extent of freedom in the method of production as with steel plate, so the problem of toughness is extremely important.

The second issue is reheating embrittlement. In particular, when adding B, the weld heat affected zone becomes brittle due to the precipitates of B and the high temperature ductility drops. This reheating embrittlement is important in thick-gauge steel materials requiring welding. On the other hand, B is a useful element for securing the amount of solid solution of Nb. This is because if adding B, which easily segregates at the grain boundaries, the segregation of Nb at the grain boundaries is inhibited.

The third issue is securing the high temperature strength. This is an issue becoming necessary since efficiently obtaining the drag effect of Nb becomes difficult when not adding B due to the second issue. For this reason, it becomes necessary to design the ingredients so as to secure the amount of solid solution C and improve the high temperature strength.

The inventors studied how to secure the toughness of the first issue, secure the reheating embrittlement resistance of the second issue, and secure the high temperature strength of the third issue.

First, to improve the toughness of the first issue, the inventors limited the content of Al to 0.005% to less than 0.030%, further limited the content of Ti to 0.005% to less than 0.040%, and made the ratio Ti/N of the contents of Ti and N (nitrogen) a range of 2 to 12.

Due to this, the inclusions and precipitates are made finer and a superior toughness can be secured. Toughness, in particular, is particularly important as a required property of thick-gauge steel materials such as H-beams.

Next, the reheating embrittlement resistance of the second issue is solved by making the content of B (boron) the level of an impurity. B is an element raising the hardenability. As shown in FIG. 1(*a*), it preferentially segregates at the crystal grain boundaries 1 to inhibit ferrite transformation and promote bainite transformation. Furthermore, the grain boundary precipitation of B inhibits the grain boundary precipitation of Nb. As a result, Nb is maintained in the solid solution state in the ferrite. Therefore, usually, when using Nb as a solid-solution strengthening element, simultaneously B is added to secure the amount of solid solution.

However, when the B segregated at the grain boundaries is subjected to heat history by welding, coarse precipitates are formed at the weld heat affected zone. For this reason, when fire etc. causes the temperature to rise, there is the problem that the weld heat affected zone rapidly falls in ductility and brittle fracture occurs. This so-called reheating embrittlement problem is extremely important in particular in thick-gauge steel plate and H-beams. The inventors clarified that in thick-gauge steel materials requiring welding, to realize fire-resistant steel using solid-solution strengthening by Nb, it is necessary to improve the high temperature strength without adding B.

Furthermore, the inventors studied in detail Nb as a solid solution element. As a result, they discovered that when not including B, x) As shown in FIG. 1(*b*), Nb segregates at the crystal grain boundary 1, y) when the amount of addition of Nb reaches a predetermined amount or more, the grain boundary precipitation of Nb becomes saturated, and z) the Nb segregating at the grain boundaries inhibits ferrite transformation and promotes bainite transformation, that is, Nb, like B, exhibits the effects of improving the hardenability of steel and enhancing the strength, and to secure the amount of solid solution, addition of a predetermined amount or more is necessary.

Based on these findings, in the fire resistant steel material not having B added of the present invention, the lower limit of the amount of addition of Nb was made 0.05%. Note that depending on the material used, sometimes, as an impurity, less than 0.0005% (5 ppm) of B is contained, but with this extent of amount, the inventors discovered there is no effect on the reheating embrittlement resistance.

The third issue, that is, the high temperature strength, is related to the first issue and second issue. In the fire resistant steel material of the present invention where high toughness and reheating embrittlement resistance are required, precipitating elements raising the high temperature strength and elements like B assisting the effect of the solid solution Nb cannot be positively included. For this reason, the role played by the solid solution Nb for securing the high temperature strength is extremely large. Therefore, it is extremely important not to allow the added Nb to precipitate as carbides such as NbC and to make it remain solid-solute.

To deal with this issue, in the above way, it is necessary to not only define the lower limit value of the amount of addition of Nb as explained above, but also to limit the amount of C so as to not form carbides. The inventors engaged in a detailed study and as a result discovered that if making the amount of C 0.03% or less, the precipitation of carbides of Nb is inhibited, the drag effect of Nb is increased, and great solid-solution strengthening is achieved. Furthermore, the inventors discover that to exhibit the action of Nb as a solid-solution strengthening element to a maximum extent, the value of C—Nb/7.74 has to be made 0.005 or less.

Further, the inventors discovered that strengthening by the drag effect of the solid solution Nb is more remarkable in effect than even the Mo added to conventional fire-resistant steel and that by adding a smaller amount of alloy, equivalent high temperature strength can be secured.

The present invention was made based on the above discoveries. In particular, it provides a fire resistant steel material superior in toughness, reheating embrittlement resistance, and high temperature strength particularly effective for application to steel shapes or thick-gauge plate and other thick-gauge steel materials needed as fire-resistant building materials, in particular fire-resistant H-beams, without containing both Mo and B, by controlling the balance of C, Nb, and Ti and the contents of the deoxidizing elements Si and Al and a method of production of the same.

Further, the present invention provides a fire resistant steel material superior in reheating embrittlement resistance which utilizes the drag effect of solid solution Nb to raise the high temperature strength and thereby secure, as hot rolled, a superior high temperature strength of a tensile strength at ordinary temperature of 400 MPa or more and a yield strength at 600° C. of 50% or more of the yield strength at ordinary temperature and inhibit the drop in toughness and, further, prevent so-called reheating embrittlement where the weld heat affected zone becomes brittle when again heated to a high temperature, in particular, a fire resistant H-beam, and a method of production of the same. Its gist is as follows:

(1) A fire resistant steel material superior in high temperature strength, toughness, and reheating embrittlement resistance characterized by containing, by mass %, C: 0.001% to 0.030%, Si: 0.05% to 0.50%, Mn: 0.4% to 2.0%, Nb: 0.03% to 0.50%, Ti: 0.005% to less than 0.040%, N: 0.0001% to less than 0.0050%, and Al: 0.005% to 0.030%, limiting P: 0.03% or less and S: 0:02% or less, having contents of C, Nb, Ti, and N satisfying $C—Nb/7.74 \leqq 0.005$ and $2 \leqq Ti/N \leqq 12$, and having a balance of Fe and unavoidable impurities.

(2) A fire resistant steel material superior in high temperature strength, roughness, and reheating embrittlement resistance as set forth in (1), characterized in that the fire resistant steel material has a cross-sectional shape of an H-shape comprised of integrally formed flanges and a web, said flanges have a plate thickness of 12 mm or more, and said web has a plate thickness of 7 mm or more.

(3) A fire resistant steel material superior in high temperature strength, toughness, and reheating embrittlement resistance as set forth in (1) or (2), characterized by further containing, by mass %, one or both of V: 0.10% or less and Mo: less than 0.10%.

(4) A fire resistant steel material superior in high temperature strength, toughness, and reheating embrittlement resistance as set forth in any one of (1) to (3), characterized by further containing, by mass %, one or both of Zr: 0.03% or less and Hf: 0.010% or less.

(5) A fire resistant steel material superior in high temperature strength, toughness, and reheating embrittlement resistance as set forth in any one of (1) to (4), characterized by further containing, by mass %, one or more of Cr: 1.5% or less, Cu: 1.0% or less, and Ni: 1.0% or less.

(6) A fire resistant steel material superior in high temperature strength, toughness, and reheating embrittlement resistance as set forth in any one of (1) to (5), characterized by further containing, by mass %, one or more of Mg: 0.005% or less, REM: 0.01% or less, and Ca: 0.005% or less.

(7) A fire resistant steel material superior in high temperature strength, toughness, and reheating embrittlement resistance as set forth in any one of (1) to (6), characterized in that an Nb and C mass concentration product is 0.0015 or more.

(8) A fire resistant steel material superior in high temperature strength, toughness, and reheating embrittlement resistance as set forth in any one of (1) to (7), characterized in that an equilibrium precipitation molar ratio of Ti—Nb-based carbonitrides at 600° C. is less than 0.3%.

(9) A method of production of a fire resistant steel material superior in high temperature strength, toughness, and reheating embrittlement resistance characterized by heating a steel slab having the ingredients described in any one of (1) and (3) to (8) to 1100 to 1350° C. and hot rolling it by a cumulative reduction rate of 30% or more at 1000° C. or less.

(10) A method of production of a fire resistant steel material superior in high temperature strength, toughness, and reheating embrittlement resistance as set forth in (9) characterized by cooling in a temperature range of 800° C. to 500° C. after the rolling by an average cooling rate of 0.1 to 10° C./s.

(11) A method of production of a fire resistant steel material superior in high temperature strength, toughness, and reheating embrittlement resistance as set forth in (2) characterized by heating a steel slab having the ingredients described in any one of (1) and (3) to (8) to 1100 to 1350° C. and using a universal rolling mill train to hot roll it by a cumulative reduction rate of 30% or more at 1000° C. or less.

(12) A method of production of a fire resistant steel material superior in high temperature strength, toughness, and reheating embrittlement resistance as set forth in (11) characterized by spray cooling the flanges from the outside and cooling in a temperature range of 800° C. to 500° C. of the flanges after the rolling by an average cooling rate of 0.1 to 10° C./s.

According to the present invention, it become possible to provide a fire resistant steel material having sufficient ordinary temperature strength and high temperature strength and superior in HAZ toughness and reheating embrittlement resistance without cold working and thermal refining treatment. The installation costs are reduced and the work period is shortened, so the costs are greatly slashed. The improvement in reliability of large-sized buildings, safety, economy, and other industrial effects are extremely great.

In particular, H-beams produced by hot rolling are classified by their shapes into locations of the flanges, web, and fillet. The rolling temperature history and cooling rate differ depending on their shapes, so even with the same ingredients, the mechanical properties will sometimes greatly change depending on the locations, but the present invention has a system of ingredients with relatively little dependency of the rolling finishing temperature and dependency of the cooling rate on the strength and toughness and can reduce variations in the material quality in cross-sectional locations of H-beams. Further, it is also possible to reduce the changes in material quality of steel plates due to plate thickness.

BEST MODE FOR CARRYING OUT THE INVENTION

The inventors had as their object the use of the drag effect of solid solution Nb to the maximum extent to develop a fire resistant steel material free of problems in the properties of the base material and weld zone, in particular, a fire resistant thick-gauge steel material, and studied in detail the (1) relationship between the C and Nb and the high temperature strength of the steel material, (2) the relationship between the Ti and N and the toughness, and (3) the relationship between the ingredients and the reheating embrittlement.

The inventors produced steel containing, by mass %, C: 0.001 to 0.030%, Si: 0.05 to 0.50%, Mn: 0.4 to 2.0%, Nb: 0.03 to 0.50%, Ti: 0.005 to less than 0.040%, N: 0.0001 to less than 0.0050%, and Al: 0.005 to 0.030%, limiting the impurities of P and S to upper limits of 0.03% or less and S: 0.02% or less, and having a balance of Fe and unavoidable impurities, cast it, heated the obtained steel slab to 1100 to 1350° C., and rolled it by a cumulative reduction rate at 1000° C. or less of 30% or more to produce steel plate of a plate thickness of 10 to 40 mm.

From the steel plate, the inventors obtained tensile test pieces based on JIS Z 2201, ran tensile tests at room temperature based on JIS Z 2241, and ran tensile tests at 600° C. based on JIS G 0567. Note that regarding the yield strength, when the yield point at room temperature is unclear, the 0.2% proof stress is applied. In calculating the 0.2% proof stress, the offset method of JIS Z 2241 is used. Further, the inventors ran Charpy impact tests based on JIS Z 2242. The results of the tests are arranged in relation to the ingredients and shown in FIG. 2 and FIG. 3.

Figure 1:
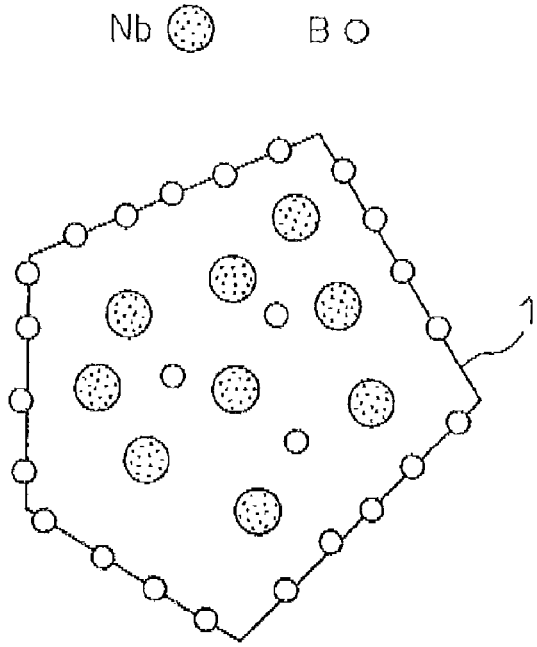
FIG. 1 is a view for explaining the drag effect of Nb, wherein (a) is a view of the case of the presence of B in addition to Nb and (b) is a view of the case of just adding Nb.
Figure 1:
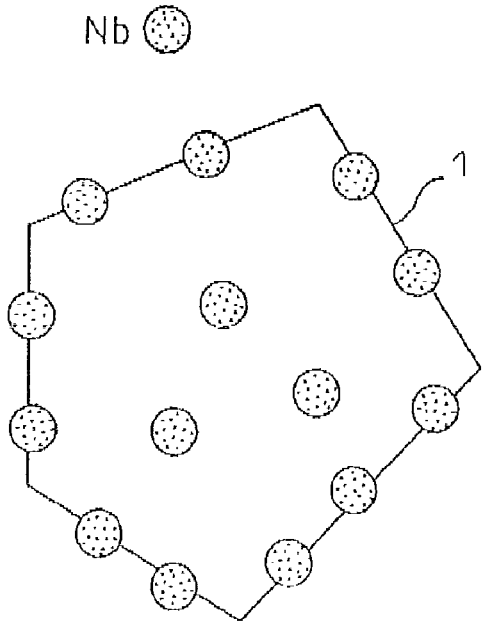
Figure 2:
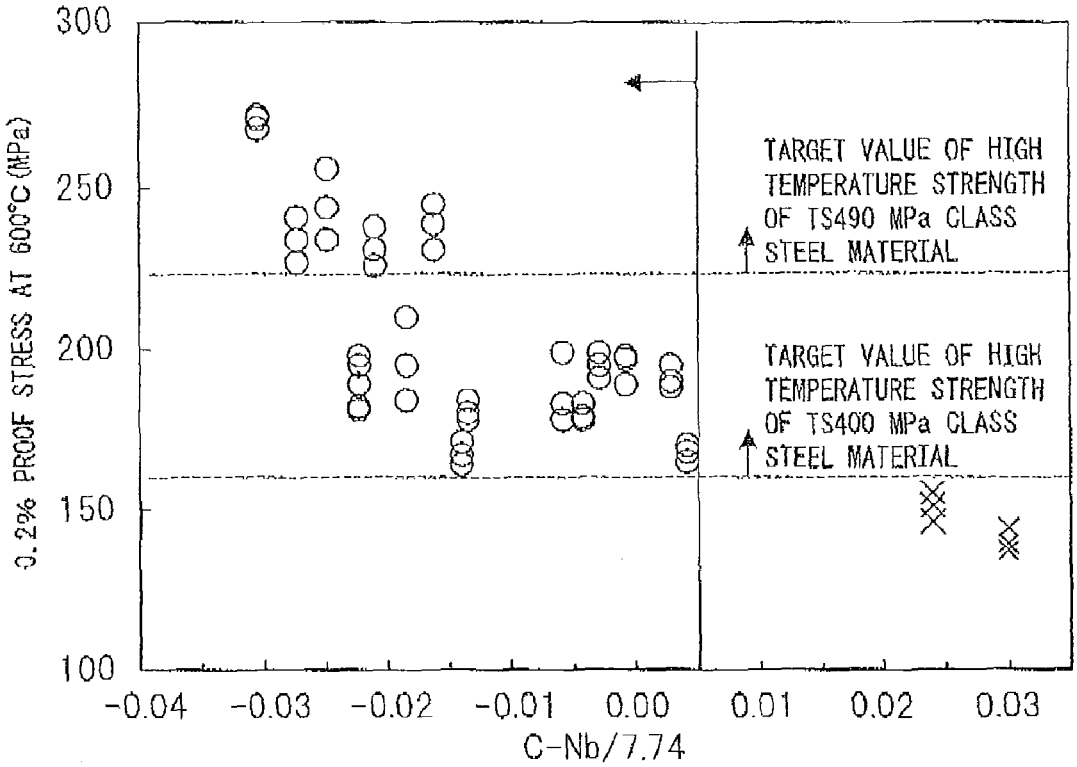
FIG. 2 is a view showing the effects of C and Nb on the high temperature strength of steel materials.

FIG. 2 shows the relationship between the contents (mass %) of the C and Nb and the high temperature strength. For the high temperature strength, C—Nb/7.74 becomes an important indicator. From FIG. 2, it is learned that if C—Nb/7.74 becomes 0.005 or less, the 0.2% proof stress at 600° C. exceeds the target values for steel materials with a tensile strength at ordinary temperature of the 400 MPa class and steel materials with one of the 490 MPa class and that therefore excellent high temperature strength is obtained.

Figure 3:
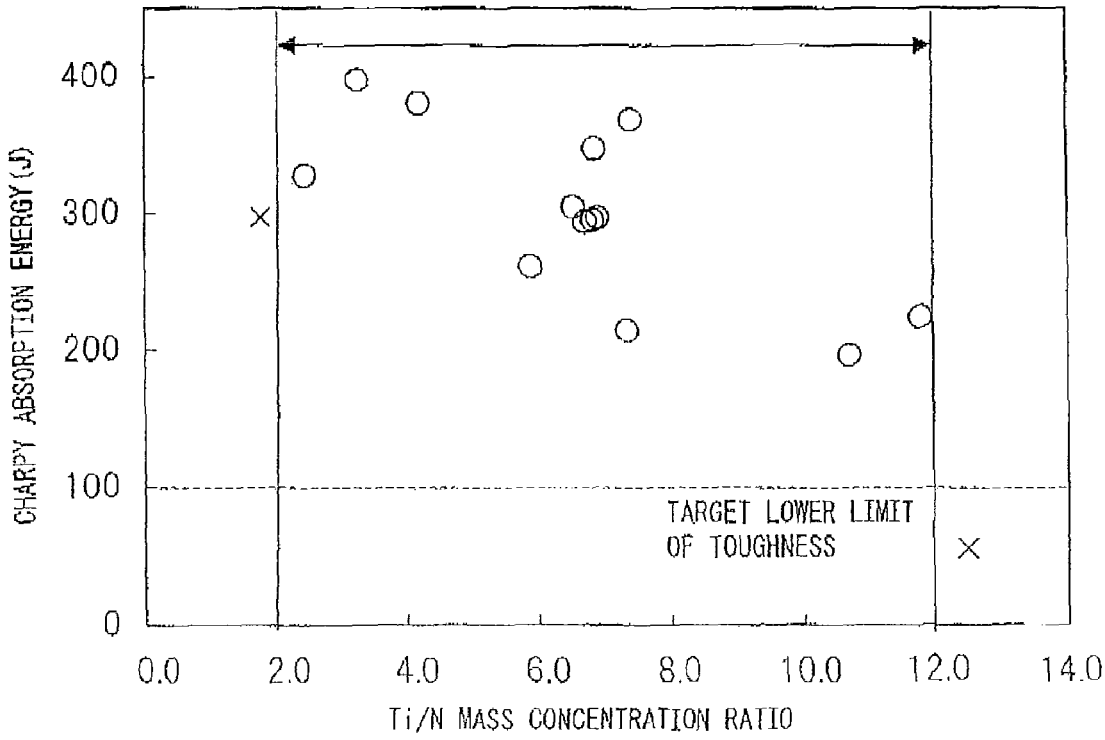
FIG. 3 is a view showing the effects of N and Ti on the toughness of steel materials.

FIG. 3 shows the relationship between the contents (mass %) of the Ti and N and the Charpy absorption energy of the base material. For the toughness, Ti/N becomes an important indicator. From FIG. 3, if Ti/N exceeds 12, the toughness falls. In the range of Ti/N of 2 to 12, it is learned that the toughness of the base material is good. Note that it was learned that if Ti/N is less than 2, the toughness is good, but the strength falls.

Furthermore, the inventors ran simulated heated cycle tests using samples with the excellent high temperature strength and HAZ toughness shown in FIGS. 2 and 3, then obtained test pieces of diameters of 10 mm, heated them to 600° C., ran tensile tests, and measured the reduction of area. Further, from the contents of C, Si, Mn, Nb, Ti, N, and Al, they calculated the equilibrium precipitation amounts of TiC, TiN, NbC, and NbN (these being referred to all together as "Ti—Nb-based carbonitrides") at 600° C. using the general use equilibrium thermodynamic calculation software Thermo-Calc® and the database TCFE2.

Figure 4:
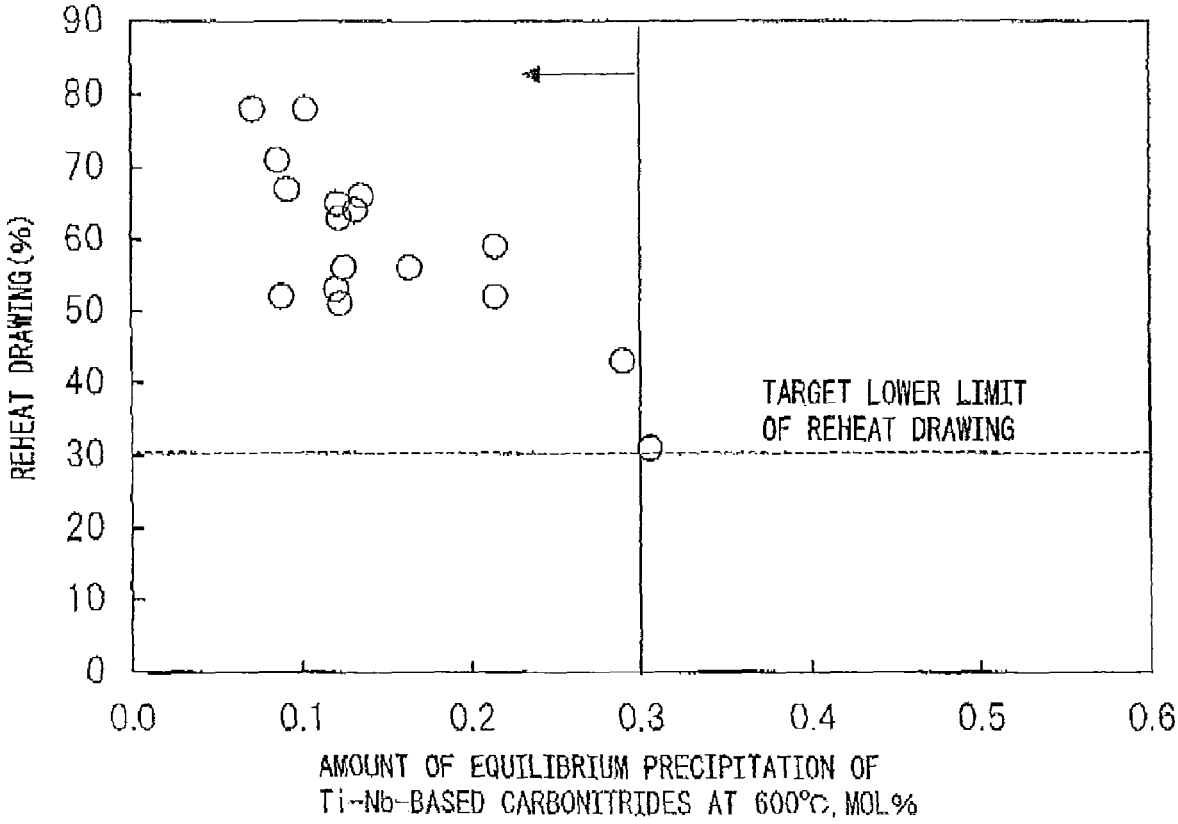
FIG. 4 is a view showing the effects of the amount of equilibrium precipitation on the reheating embrittlement characteristic of steel materials.

As shown in FIG. 4, if containing C: 0.001 to 0.030%, Si: 0.05 to 0.50%, Mn: 0.4 to 2.0%, Nb: 0.03 to 0.50%, Ti: 0.005 to less than 0.040%, N: 0.0001 to less than 0.0050%, and Al: 0.005 to 0.030% and satisfying C—Nb/7.74≦0.005 and 2≦Ti/N≦12, the reheat reduction of area is an excellent 30% or more. Simultaneously, if the equilibrium precipitation molar ratio of Ti—Nb-based carbonitrides at 600° C. is less than 0.3%, it becomes a more excellent 40% or more. In this way, as one reason for the improvement of the reheating embrittlement resistance of the fire resistant steel material of the present invention, it is considered that the precipitation of Ti—Nb-based carbonitrides at 600° C. is suppressed to an extremely low level by the amounts of addition and balance of C, N, Ti, and Nb.

In the above way, it was learned that in the fire resistant steel material of the present invention not containing B, if optimizing the relationship between C and Nb and the relationship between Ti and N, the solid solution Nb is secured and the precipitation of carbides and nitrides at the crystal grain boundaries of the weld heat affected zone is inhibited, which is extremely effective for the prevention of reheating embrittlement. Further, it is also possible to suitably add V, Mo, Zr, Hf, REM, Cr, Cu, Ni, and Mg to the ingredients in accordance with need so as to further improve the properties.

Below, the reasons for limitation of the ingredients of the steel material of the present invention will be explained. Note that the % of the contents of the elements indicate mass %.

C has to be added in an amount of 0.001% or more to obtain the strength required as a structural use steel material. Preferably, it is included in 0.005% or more. However, if the content exceeds 0.030%, Nb precipitates as the carbides NbC and the amount of solid solution Nb contributing to solid-solution strengthening is reduced. Therefore, to obtain a strengthening effect by the drag effect of the solid solution Nb, it is necessary to make the upper limit of the amount of C 0.030%. Furthermore, to secure the strengthening effect due to the drag effect of the solid solution Nb, the upper limit is preferably made 0.020% or less. To prevent the formation of coarse carbides and improve the toughness and reheating embrittlement resistance of the base material and weld heat affected zone, the upper limit is more preferably made 0.015% or less.

Si is an extremely important element in the present invention. The thick-gauge steel plate and steel shapes of the present invention differ from thin-gauge steel plate in requiring the amount of Al having a detrimental effect on the toughness to be reduced. For this reason, Si is extremely useful as a deoxidizing element. Furthermore, it is a strengthening element raising the ordinary temperature strength. To obtain this effect, addition of 0.05% or more of Si is necessary, so the lower limit was made 0.05%. On the other hand, if the amount of addition of Si exceeds 0.50%, low melting point oxides are formed and scale removability is worsened, so the upper limit is made 0.50%, more preferably the upper limit is made 0.20%.

Mn is an element raising the hardenability. Securing the strength and toughness of the base material requires the addition of 0.4% or more. Addition of 0.6% or more is preferable. When a higher strength of the base material is required, addition of 0.8% or more is more preferable. Most preferably, 1.1% or more is added. On the other hand, if the amount of addition of Mn exceeds 2.0%, when producing the steel slab in continuous casting, the center segregation becomes remarkable and the hardenability excessively rises and the toughness deteriorates at the segregated part, so the upper limit was made 2.0%.

Nb is added in an amount of 0.03% or more, preferably 0.05% or more, to secure the solid solution Nb and utilize the drag effect of Nb. To raise the high temperature strength, Nb is more preferably added in an amount of 0.10% or more. In the present invention, solid solution Nb is extremely important. It raises the hardenability and raises the ordinary temperature strength and also increases the deformation resistance by the drag effect of dislocations to secure strength even in the high temperature region. Therefore, the more preferable lower limit of the amount of Nb is over 0.20%. Due to this, the solid solution amount of Nb is secured and the effect of the drag effect and improvement of hardenability can be exhibited to the maximum extent and the strength at ordinary temperature and high temperature can be remarkably raised. On the other hand, addition over 0.50% of Nb becomes disadvantageous economically as compared with the effect, so the upper limit was made 0.50%.

Further, Nb is a powerful carbide forming element. It precipitates forming NbC with the excess C, so to secure the solid solution Nb, it is essential to consider the balance with the amount of addition of C. To secure the solid solution Nb and obtain a sufficient high temperature strength by the drag effect, it is necessary to satisfy $$C—Nb/7.74 \leqq 0.005$$

Note that C and Nb are the contents of C and Nb expressed in units of mass %.

To secure higher high temperature strength, making the C—Nb/7.74 a minus value of less than 0.000 where Nb becomes somewhat excessive is preferable. The lower limit is not particularly defined, but the lower limit value of C—Nb/7.74 found from the lower limit value of C and the upper limit value of Nb is −0.064.

Figure 5:
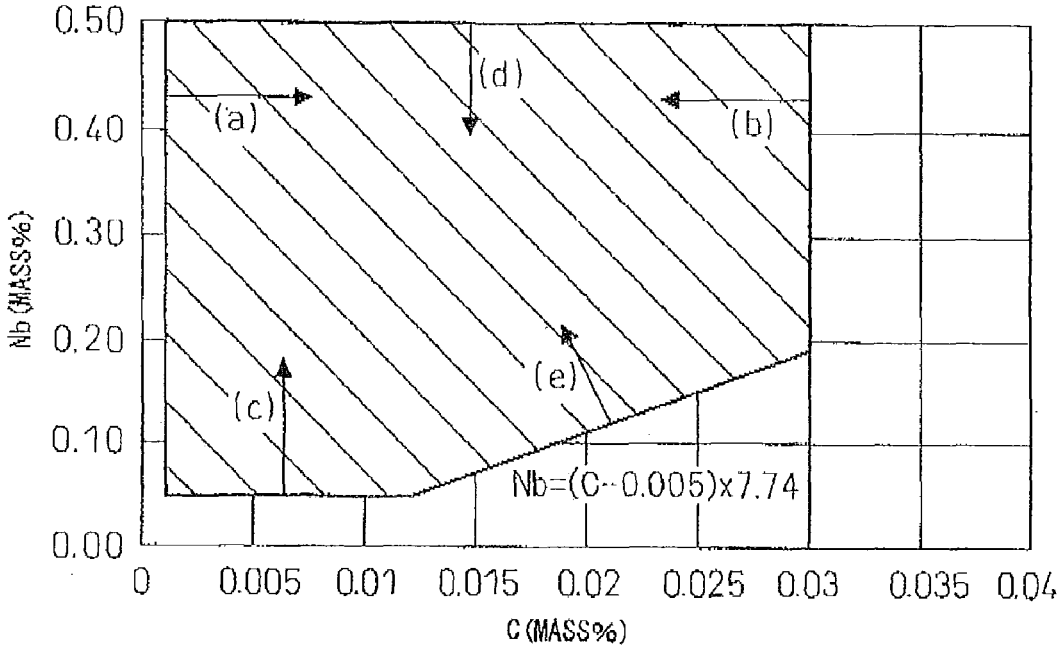
FIG. 5 is a view showing the suitable ranges of the amounts of addition of Nb and C.

Summarizing the above, the amounts of addition of Nb and C and the suitable range of the balance are shown in FIG. 5. The solid line (a) in the figure means to make the lower limit of the amount of C 0.001% or more to secure the strength, the solid line (b) means to make the upper limit of the amount of C 0.030% or less to secure the toughness, the solid line (c) means to make the lower limit of the amount of Nb 0.03% or more to secure the high temperature strength, and the solid line (d) means to make the upper limit of the amount of Nb 0.50% or less from the viewpoint of the alloy costs. Further, the solid line (e) in the figure means to make the relationship of the amount of C and the amount of Nb $Nb \geqq 7.74 \times (C-0.005)$ so as to secure the solid solution Nb and raise the high temperature strength.

Note that the product of the contents of Nb and C expressed by mass %, that is, the Nb and C mass concentration product, becomes an indicator of the amount of solid solution Nb, so is limited in accordance with need so as to further improve the high temperature strength. The Nb and C mass concentration product is preferably 0.0015 or more. The upper limit is not defined, but the upper limit value of the Nb and C mass concentration product found from the upper limit values of the contents of Nb and C of the steel of the present invention is 0.015.

Al is an element used for deoxidizing molten steel. To avoid insufficient deoxidization and sufficient obtain strength of the steel at room temperature and high temperature, addition of 0.005% or more is necessary. To control the concentration of solute oxygen after deoxidation and make the Ti effectively act for reduction of the amount of solid solution N, Al is preferably added in an amount of 0.010% or more. On the other hand, in particular in the case of steel shapes or thick-gauge plate, if containing over 0.030% of Al, this forms island-like martensite which degrades the toughness of the base material. Further, this also has a detrimental effect on the high temperature strength of the weld zone, so the upper limit was made 0.030% or less. When a further improvement of the toughness of the base material or improvement of the reheating embrittlement resistance of the weld heat affected zone is sought, it is preferable to limit this to less than 0.030%. Limiting it to 0.025% or less is more preferable.

Ti is an element forming carbides and nitrides and in particular easily forms TiN at a high temperature. Due to this, it is possible to inhibit the precipitation of NbN, so addition of Ti is extremely effective in securing the solid solution Nb as well. Further, in the steel material of the present invention, Ti forms stable TiN in the temperature region up to 1300° C., so this inhibits the coarsening of the NbN precipitating segregated at the crystal grain boundaries of the HAZ and contributes to the improvement of toughness as well. To obtain this effect, it is necessary to add Ti in an amount of 0.005% or more. On the other hand, if the content of Ti becomes 0.040% or more, coarse TiN is formed and the toughness of the base material is impaired, so the upper limit is made less than 0.040%. Furthermore, when toughness of the base material is required, the upper limit is preferably made 0.030% or less and the upper limit is more preferably made 0.020% or less.

N is an element forming nitrides. To inhibit the reduction of the solid solution Nb, the upper limit was made less than 0.0050%. The content of N is preferably an extremely low concentration, but making it less than 0.0001% is difficult. Note that from the viewpoint of securing the toughness, the upper limit is preferably made 0.0045% or less.

Further, to inhibit the precipitation of coarse NbN and TiN and secure the toughness, the balance of Ti and N is extremely important. It is necessary to make Ti/N 12 or less. Preferably, it is made 10 or less. Note that Ti and N are the contents of Ti and N in units of mass %.

On the other hand, to sufficiently obtain the effect of inhibition of formation of NbN by the formation of TiN and secure high temperature strength, it is necessary to make Ti/N 2 or more. Making it 3 or more is preferable.

Figure 6:
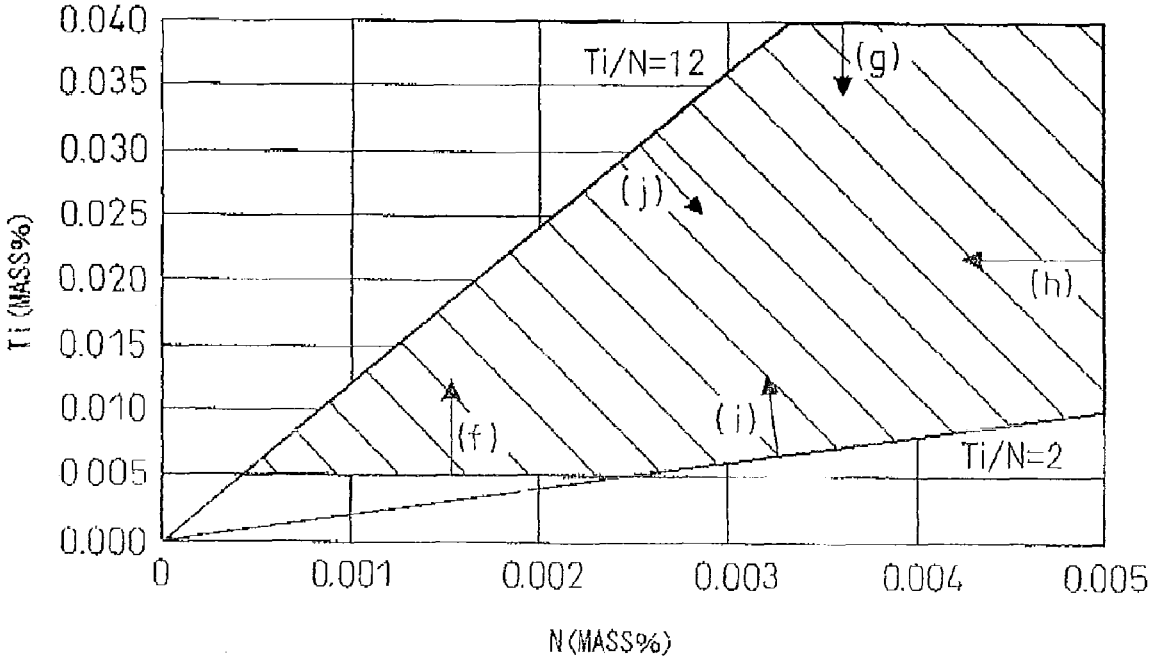
FIG. 6 is a view showing the suitable ranges of the amounts of addition of Ti and N.

Summarizing the above, the amounts of addition of Ti and N and the suitable range of the balance are shown in FIG. 6. The solid line (f) in the figure means to make the lower limit of the amount of Ti 0.005% or more to secure the high temperature strength, that is, to secure the amount of solid solution Nb by precipitation of TiN, the solid line (g) means to make the upper limit of the amount of Ti less than 0.04% to secure toughness, that is, to prevent the precipitation of coarse TiN, and the solid line (h) means to make the upper limit of the amount of N less than 0.0050% to secure the high temperature strength, that is, to inhibit the precipitation of NbN to secure the amount of solid solution Nb. Further, the solid line (i) means to make the lower limit of Ti/N 2 or more to secure the high temperature strength, that is, to secure the amount of solid solution Nb by precipitation of TiN, while the solid line (j) means to make the upper limit of the Ti/N 12 or less to secure the toughness, that is, to prevent coarsening of the TiN.

Note that the steel material of the present invention satisfies the limitations on ingredients of not containing B, lowering the C and N, and adding suitable amounts of Nb and Ti, so the reheating embrittlement resistance is good. Furthermore, the direct cause of the improvement of the reheating embrittlement resistance is believed to be that the precipitation of carbides and nitrides containing Nb and Ti is inhibited when the material is heated to a high temperature. Therefore, the equilibrium precipitation molar ratio of Ti—Nb-based carbonitrides at 600° C. is preferably less than 0.3%.

The equilibrium precipitation molar ratio of Ti—Nb-based carbonitrides at 600° C. can be found by heating the steel material at 600° C., electrolyzing a sample using a non-aqueous solvent so that no precipitates remain in the steel, quantitatively analyzing the residue obtained by filtering the electrolytic solution by the X-ray diffraction method and quantitatively analyzing it again. However, making the precipitation of the Ti—Nb-based carbonitrides an equilibrium state requires long heat treatment. Measurement is troublesome, so performing this for all cases is difficult.

For this reason, the equilibrium precipitation molar ratio may also be found by thermodynamic equilibrium calculation. For example, it is possible to use the general use thermodynamic equilibrium calculation software Thermo-Calc® and database TCFE2 to calculate this by the contents of C, Si, Mn, Nb, Ti, N, and Al. Further, when containing the optional elements V, Mo, Zr, Hf, Cr, Cu, Ni, and Mg, the contents of these are also preferably input. Note that the inventors confirmed that similar results are obtained by thermodynamic equilibrium calculation even if using other software and databases.

P and S are impurities. The lower the lower limits, the more preferable, so while not particularly limited, if the contents of P and S are over 0.03% and over 0.02%, weld cracks and a drop in toughness occur due to solidification segregation. Therefore, the upper limits of the contents of P and S are made 0.03% and 0.02%.

Next, the selectively added ingredients will be explained.

V and Mo, like Nb and Ti, are elements forming carbides and nitrides. When the contents of C and N are low, the carbides and nitrides are mainly formed of Nb and Ti. For this reason, V and Mo do not contribute to precipitation strengthening by carbides and nitrides, but contribute to strengthening by becoming solid-solute in the ferrite.

V is preferably added in an amount of 0.01% or more so as to sufficiently exhibit the effect of solid-solution strengthening. Addition of 0.05% or more is more preferable. On the other hand, even if excessively adding V over 0.10%, the effect becomes saturated and the economicalness is also impaired, so the upper limit of V is preferably made 0.10%.

Mo is a useful element contributing to not only the effect of solid-solution strengthening, but also strengthening of the structure by improvement of the hardenability. However, in the present invention, when adding this as a strengthening element, the upper limit is preferably made less than 0.10% so as to prevent the economicalness from being greatly impaired.

Zr is an element forming nitrides stabler at a high temperature than Ti. It contributes to the reduction of the solid solution N in the steel. By further adding Zr, it is possible to secure more solid solution Nb than the case of adding Ti alone. To obtain this effect, addition of 0.001% or more of Zr is preferable. To inhibit the precipitation of NbN and obtain the effect of raising the high temperature strength and improving the reheating embrittlement characteristic, it is more preferable to add Zr in an amount of 0.010% or more. On the other hand, if including Zr in over 0.030%, coarse ZrN is formed in the molten steel before casting and the toughness is impaired, so the upper limit is preferably made 0.030%.

Hf has an effect similar to Ti. To obtain that effect, addition of 0.001% or more is preferable. On the other hand, addition of Hf of over 0.010% sometimes lowers the toughness, so the upper limit is preferably made 0.010%.

Cr is an element raising the hardenability and contributing to the strengthening of the base material. To obtain that effect, addition of 0.1% or more is preferable. On the other hand, if excessively adding Cr, the toughness is sometimes impaired, so the upper limit is preferably made 1.5%. The more preferable upper limit of the amount of Cr is 1.0% or less.

Cu is an element contributing to the strengthening of the base material in the same way as Cr. Addition of 0.1% or more is preferable. On the other hand, if excessively adding Cu, the toughness is sometimes impaired, so the upper limit is preferably made 1.0%.

Ni is an element contributing to the strengthening of the base material by improvement of the hardenability. Even if excessively added, there is little detrimental effect on the properties. To effectively obtain the effect of the strengthening of the base material, addition of Ni in an amount of 0.1% or more is preferable. On the other hand, the upper limit of the amount of Ni is preferably made 1.0% or less from the viewpoint of economy.

Mg is a powerful deoxidizing element and forms Mg-based oxides stable at a high temperature. Even when heated to a high temperature at the time of welding, it does not become solid-solute in the steel and has the function of pinning the grain boundaries. Due to this, it makes the structure of the HAZ finer and inhibits the drop in the toughness. To obtain this effect, addition of 0.0005% or more of Mg is preferable. However, if adding Mg over 0.0050%, the Mg-based oxides become coarser and no longer contribute to pinning inhibiting grain growth. Coarse oxides sometimes impair the toughness, so the upper limit is preferably made 0.0050%.

An REM (rare earth element) reacts in the steel to oxidize and sulfurize and form oxides and sulfides. These oxides and sulfides are stable at a high temperature. Even when heated to a high temperature at the time of welding, it does not become solid-solute in the steel and has the function of pinning the grain boundaries. Due to this, it is possible to make the structure of the HAZ finer and inhibit the drop in the toughness. To obtain this effect, the total content of all of these rare earth metals is preferable made 0.001% or more. On the other hand, if adding an REM in an amount over 0.010%, the volume percentage of the oxides and sulfides rises and the toughness is lowered sometimes, so the upper limit is preferably made 0.010%.

Ca, if added in a small amount, exhibits the effect of inhibiting the flattening of the sulfides in the rolling direction in the hot rolling. Due to this, the toughness is improved. In particular, this contributes to improvement of the Charpy value in the plate thickness direction. To obtain this effect, addition of Ca in an amount of 0.001% or more is preferable. On the other hand, if adding Ca in over 0.005%, the volume percentage of oxides and sulfides rises and the toughness is reduced in some cases, so the upper limit is preferably made 0.005%.

It is known that the metal structure of the low carbon steel covered by the present invention is mainly formed with a polygonal ferrite structure, massive ferrite structure, and bainite structure in accordance with the cooling rate etc. Among these structures, the massive ferrite structure and bainite structure can increase the strength since solid-solution strengthening by Nb effectively acts. For this reason, the preferable metal structure of the steel of the present invention is either a massive ferrite structure or bainite structure or a mixed structure of both.

The massive ferrite structure is a structure where the austenite structure diffuses in a ferrite structure of the same composition and transforms during the cooling process and has the same composition before and after transformation. For this reason, not the diffusion of carbon atoms, but the self diffusion of iron atoms (rearrangement of lattice) becomes the stage regulating the speed of the transformation. Therefore, since a massive ferrite structure is formed by a shorter distance of movement of atoms and a relatively fast transformation rate, the crystal grains become larger in size than polygonal ferrite structures and the dislocation density is high. Therefore, this is a structure suitable for solid-solution strengthening. This is the reason why a massive ferrite structure is preferable to a polygonal ferrite structure as the structure of the steel of the present invention. Further, the Nb carbides NbC and nitrides NbN form nuclei for forming polygonal ferrite structures, so reducing the amount of C and reducing the amount of N are effective not only for securing solid solution Nb, but also inhibiting the formation of polygonal ferrite structures.

Regarding identification of these metal structures, the bainite structure which carbides form in the grains can be differentiated from a massive ferrite structure or polygonal ferrite structure by an optical microscope. On the other hand, the massive ferrite structure is difficult to differentiate from a polygonal ferrite structure by observation of the structure by an optical microscope although the crystal grain sizes differ. For clear differentiation of the massive ferrite structure and polygonal ferrite structure, observation by a transmission type electron microscope is necessary.

Note that the metal structure of the steel of the present invention includes, in addition to a massive ferrite structure, bainite structure, and polygonal ferrite structure, a small amount of a martensite structure, residual austenite structure, or pearlite structure in some cases. That is, the presence of such generally occurring structures is not excluded.

Formation of a massive ferrite structure and bainite structure is promoted by raising the hardenability of the steel. For this reason, the Ceq, a hardenability indicator, is preferably made 0.05 or more. Further, if the Ceq is too high, the strength rises and the toughness is impaired in some cases, so the upper limit is more preferably made 0.60 or less. Note that $$Ceq=C+Si/24+Mn/6+Ni/40+Cr/5+Mo/4+V/14$$

In the formula, C, Si, Mn, Ni, Cr, Mo, and V are the contents [mass %] of the elements.

The fire resistant steel material of the present invention is configured as explained above, but in particular is effective for thick-gauge steel plate of a plate thickness of 10 mm or more, H-beams of a web thickness of 7 mm or more, in particular H-beams of a flange thickness of 12 mm or more. In such a steel material, when welding, reheating embrittlement of the HAZ easily occurs, but in the present invention, as explained above, no B is contained, C and N are reduced, and suitable amounts of Nb and Ti are added, so not only is it possible to secure high temperature strength, but also it is possible to inhibit precipitation of carbides or nitrides at the crystal grain boundaries of the HAZ at the time of welding and prevent reheating embrittlement.

H-beams are representative building structural members, that is, steel materials of cross-sectional shapes of H-shapes comprised of flanges at the two sides and a web between them. In particular, when the flanges have a plate thickness of 12 mm or more and the web has a plate thickness of 7 mm or more, when used as fire-resistant H-beams, a superior toughness and high temperature ductility of the weld heat affected zone are demanded. Therefore, the fire resistant steel material of the present invention can exhibit its maximum effect when used as such an H-beam.

Next, the method of production will be explained.

Steels having the above ingredients were produced and cast to make steel slabs. From the viewpoint of productivity, continuous casting is preferable. The obtained steel slabs are hot rolled to form them into steel plates or steel shapes and then cooled. Note that the steel materials covered by the present invention include rolled steel plates, H-beams, I-beams, steel angles, steel channels, steel unequal angles, and other steel shapes. Among these, for building materials in which fire resistance and reheating embrittlement resistance are required, in particular H-beams are suitable.

To produce steel materials by hot rolling, to facilitate plastic deformation and ensure that Nb sufficiently becomes solid-solute, it is necessary to make the lower limit of heating temperature of the steel slab 1100° C. The upper limit of the heating temperature of steel slabs was made 1350° C. considering the heating furnace performance and economy. To make the microstructure of the steel finer, the upper limit of the heating temperature of the steel slab is preferably made 1300° C. or less.

In the hot rolling, the cumulative reduction rate at 1000° C. or less is preferably made 30% or more. Due to this, it is possible to promote the recrystallization in the hot working so as to make the crystal grains finer and improve the toughness and strength of the steel material. Further, by completing the hot rolling in the temperature range where the steel structure is the single austenite phase (called the "γ single phase region") or completing it in the state with a low volume percent of the ferrite formed by phase transformation, it is possible to avoid a remarkable rise in the yield point, drop in toughness, anisotropy of the toughness, and other deterioration of the mechanical properties. Therefore, the end temperature of the hot rolling is preferably made 800° C. or more.

Furthermore, after the hot rolling, controlled cooling in the 800 to 500° C. temperature range by a 0.1 to 10° C./s average cooling rate is preferable. By this accelerated cooling, the steel material is further improved in strength and toughness. To obtain this effect, accelerated cooling by an average cooling rate of 0.1° C./s or more is preferable. On the other hand, with over 10° C./s average cooling rate, the bainite structure or martensite structure rises in structural percentage and the toughness falls sometimes, so the upper limit is preferably made 10° C./s.

Figure 7:
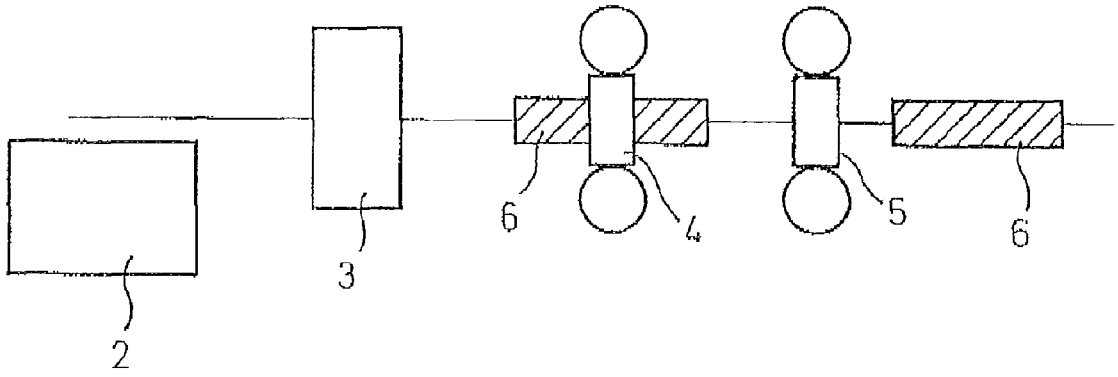
FIG. 7 is a schematic view showing an example of the layout of facilities for working the method of the present invention.

To produce H-beams, the universal rolling mill train illustrated in FIG. 7 is used for hot rolling. The universal rolling mill train is for example comprised of a heating furnace 2, rough rolling mill 3, process rolling mill 4, and final rolling mill 5. To control the mechanical properties of the steel material, for accelerated cooling, it is preferable to set flange water-cooling systems 6 before and after the process hot rolling mill 4 and the exit side of the final rolling mill 5.

When using this universal rolling mill train for hot rolling, to facilitate plastic deformation and ensure that Nb sufficiently becomes solid-solute, it is necessary to make the heating temperature of the steel slab 1100° C. or more. On the other hand, the upper limit of the heating temperature is preferably made 1350° C. or less from the viewpoint of the heating furnace performance and economy. To refine the microstructure of the steel, the temperature is more preferably made 1300° C. or less.

In the hot rolling, to make the crystal grains finer and improve the toughness and strength, it is preferable to make the cumulative reduction rate at 1000° C. 30% or more. In the case of an H-beam, the cumulative reduction rate is represented by the change of the plate thickness of the flanges. That is, the difference between the plate thickness of the flanges before rolling and the plate thickness of the flanges after rolling divided by the plate thickness of the flanges before rolling is the reduction rate of the individual rolling passes and is expressed as a percentage. The cumulative reduction rate is the total of the reduction rates of the individual rolling passes.

Further, to avoid a remarkable rise in the yield point, drop in toughness, anisotropy of the toughness, and other deterioration of the mechanical properties, the hot rolling is preferably ended at the γ single phase region or ended in the state with a small volume percentage of ferrite formed by phase transformation. For this reason, the preferable lower limit of the end temperature of the hot rolling is 800° C. Note that to refine the crystal grains in size, as explained above, it is preferable to provide water-cooling systems before and after the process rolling mill for accelerated cooling during the hot rolling.

Furthermore, after hot rolling, it is preferable to cool the beam by an average cooling rate of the flange in the temperature range from 800° C. to 500° C. of 0.1 to 10° C./s. By accelerated cooling by an average cooling rate of 0.1° C./s or more, it is possible to cause the formation of a massive ferrite structure and bainite structure and make the Nb effectively act for solid-solution strengthening. On the other hand, to inhibit the formation of a bainite structure or martensite structure and prevent a drop in toughness due to the excessive rise of the strength, it is preferable to make the upper limit 10° C./s. In particular, the flanges are locations where the plate thickness is large and toughness and reheating embrittlement resistance are required, so it is preferable to set a flange water-cooling system at the exit side of the final rolling mill and spray cool the flanges from the outside after rolling to perform the above-mentioned accelerated cooling.

Below, examples will be used to further explain the workability and effects of present invention.

EXAMPLES

Example 1

Steels comprised of the ingredients shown in Table 1 were produced by a converter, had alloys added, then were continuously cast to steel slabs of 250 to 300 mm thickness (cast slabs). The obtained steel slabs were hot rolled by the universal rolling mill train shown in FIG. 7 under the conditions shown in Tables 2 and 3 to obtain H-beams having cross-sectional shapes of H-shapes comprised of a web 7 and pair of flanges 8 shown in FIG. 8. Note that the webs of the H-beams had heights of 150 to 900 mm, and the flanges had widths of 150 to 400 mm.

As shown in FIG. 7, each steel slab was heated in a heating furnace 2, taken out from the heating furnace, then rolled by a rough rolling mill 3, process rolling mill 4, and final rolling mill 5. Flange water-cooling systems 6 were provided before and after the process rolling mill 4, the outside surfaces of the flanges were repeatedly spray cooled and reverse rolled, and the beams were water-cooled between the rolling passes. Furthermore, the flange water-cooling system 6 set at the exit side of the final rolling mill 5 was used to spray cool the outside surfaces of the flanges after the end of the rolling and acceleratedly cool the beams after rolling.

Figure 8:
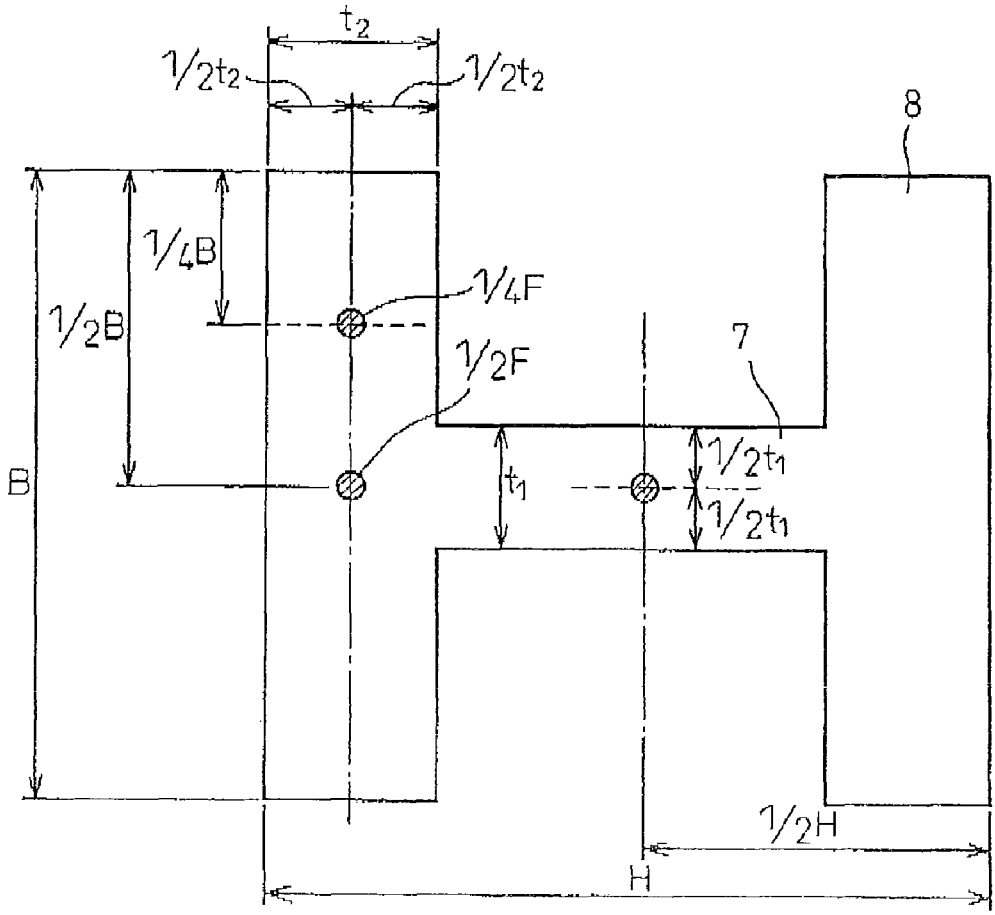
FIG. 8 is a view showing the cross-sectional shape of an H-beam and the positions for taking samples for mechanical tests.

As shown in FIG. 8, tensile test pieces were taken based on JIS Z 2201 from locations of the centers (½t2) of the plate thickness t2 of the flanges 8 of the H-beam and ¼ of the total length (B) of the flange width (called the "flanges"), of the centers (½t2) of the plate thickness t2 of the flanges 8 and ½ of the total length (B) of the flange width (called the "fillets"), and of the centers (½t1) of the plate thickness t1 of the web 7 and ½ of the total length (H) of the web height (called the "webs"). The ordinary temperature tensile test was performed based on JIS Z 2241. The 0.2% proof stress at 600° C. was measured based on JIS G 0567.

Note that the properties of these locations were found because it was judged that the locations are representative locations in the cross-sections of the H-beams and can show average mechanical properties of the H-beams and fluctuations in the cross-sections. The Charpy impact test was performed based on JIS Z 2242 by taking small pieces from the fillets.

Further, the reheating embrittlement of the HAZ was evaluated not by actual welding and evaluation of the properties of the HAZ, but by a simulation test applying a heat cycle similar to the welding to a sample. Specifically, a rod-shaped test piece of a diameter of 10 mm was taken from the flange ¼F part of the H-beam, heated by a rate of temperature rise of 10° C./s to 1400° C. and held there for 1 second, cooled by a cooling rate from 800° C. to 500° C. of 15° C./s, heated by a rate of temperature rise of 1° C./s to 600° C., held there for 600 seconds, than give tensile stress at a rate of rise of 0.5 MPa/s and evaluated by the reduction of area of the broken part, that is, was evaluated by the simulated HAZ reheating embrittlement reduction of area.

The results are shown in Tables 2 and 3. Production Nos. 1 to 17 are invention examples. The H-beams of Production Nos. 1, 2, 6 to 10, 13, 16, and 17 had target yield point ranges at ordinary temperature of the lower limit value or more of the 400 MPa class of the JIS standard, while the H-beams of Production Nos. 3 to 5, 11, 12, 14, and 15 had target yield point ranges at ordinary temperature of the lower limit value or more of the 490 MPa class of the JIS standard. Further, the H-beams of Production Nos. 1 to 17 had yield ratios (YP/TS) satisfying the 0.8 or lower low YR value. Furthermore, for the yield point at 600° C., they had tensile strengths at ordinary temperature of 157 MPa or more for the 400 MPa class and 217 MPa for the 490 MPa class, had Charpy absorption energies of the standard value of 100 J or more, and sufficiently satisfied the standard for evaluation of the reheating embrittlement resistance of the simulated HAZ reheat reduction of area of 30% or more. On the other hand, the comparative examples of Production Nos. 18 to 25 have added ingredients shown by underlines in Table 1 outside the ranges prescribed in the present invention, so the required properties cannot be obtained as shown by the underlines in Table 3.

TABLE 1

| Steel | Chemical ingredients (mass %) | | | | | | | | | |
|---|---|---|---|---|---|---|---|---|---|---|
| no. | C | Si | Mn | P | S | Ti | Nb | N | Al | Others |
| A | 0.010 | 0.15 | 1.55 | 0.004 | 0.006 | 0.020 | 0.22 | 0.0034 | 0.028 | |
| B | 0.030 | 0.30 | 1.50 | 0.003 | 0.005 | 0.030 | 0.21 | 0.0028 | 0.010 | |
| C | 0.007 | 0.10 | 1.60 | 0.004 | 0.005 | 0.018 | 0.29 | 0.0043 | 0.011 | |
| D | 0.010 | 0.15 | 1.45 | 0.004 | 0.006 | 0.015 | 0.24 | 0.0022 | 0.010 | Mo: 0.08 |
| E | 0.020 | 0.20 | 1.55 | 0.004 | 0.004 | 0.013 | 0.28 | 0.0019 | 0.024 | V: 0.04 |
| F | 0.010 | 0.16 | 1.55 | 0.004 | 0.005 | 0.013 | 0.25 | 0.0040 | 0.010 | Zr: 0.01 |
| G | 0.030 | 0.20 | 1.50 | 0.005 | 0.003 | 0.020 | 0.20 | 0.0030 | 0.028 | Zr: 0.02, Cr: 0.5, Hf: 0.007 |
| H | 0.010 | 0.16 | 1.35 | 0.004 | 0.004 | 0.020 | 0.10 | 0.0030 | 0.010 | N: 0.4, Cu: 0.6 |

TABLE 1-continued

| | | | | | | | | | | |
|---|---|---|---|---|---|---|---|---|---|---|
| I | 0.007 | 0.15 | 1.70 | 0.005 | 0.005 | 0.020 | 0.06 | 0.0027 | 0.024 | Zr: 0.01, Cr: 0.5, Ni: 0.3, Cu: 0.5 |
| J | 0.0020 | 0.20 | 1.55 | 0.003 | 0.005 | 0.015 | 0.20 | 0.0023 | 0.010 | Mg: 0.002 |
| K | 0.005 | 0.05 | 1.60 | 0.005 | 0.006 | 0.020 | 0.25 | 0.0029 | 0.028 | Zr: 0.01, Cr: 1.2, Mg: 0.001 |
| L | 0.010 | 0.15 | 1.35 | 0.004 | 0.006 | 0.028 | 0.27 | 0.0041 | 0.024 | Ni: 0.3, Cu: 0.5 |
| M | 0.010 | 0.15 | 0.80 | 0.005 | 0.006 | 0.026 | 0.11 | 0.0033 | 0.028 | Cr: 1.5, Ni: 0.7, Cu: 0.9 |
| N | 0.005 | 0.05 | 0.40 | 0.004 | 0.005 | 0.011 | 0.45 | 0.0045 | 0.024 | |
| O | 0.010 | 0.35 | 1.55 | 0.004 | 0.005 | 0.022 | 0.25 | 0.0030 | 0.024 | |
| P | 0.015 | 0.14 | 1.52 | 0.006 | 0.006 | 0.014 | 0.22 | 0.0019 | 0.028 | |
| Q | 0.008 | 0.30 | 1.84 | 0.006 | 0.005 | 0.020 | 0.17 | 0.0017 | 0.028 | |
| R | 0.040 | 0.20 | 1.55 | 0.004 | 0.005 | 0.030 | 0.20 | 0.0024 | 0.028 | |
| S | 0.020 | 0.15 | 2.10 | 0.005 | 0.005 | 0.010 | 0.25 | 0.0025 | 0.024 | |
| T | 0.030 | 0.15 | 1.54 | 0.004 | 0.006 | 0.018 | 0.05 | 0.0032 | 0.024 | |
| U | 0.020 | 0.20 | 1.44 | 0.005 | 0.005 | 0.040 | 0.10 | 0.0068 | 0.024 | |
| V | 0.010 | 0.15 | 1.60 | 0.004 | 0.005 | 0.010 | 0.08 | 0.0057 | 0.024 | Ni: 0.7, Cu: 0.8 |
| W | 0.050 | 0.20 | 0.60 | 0.006 | 0.004 | 0.018 | 0.53 | 0.0026 | 0.010 | Cr: 1.2 |
| X | 0.040 | 0.15 | 1.35 | 0.005 | 0.004 | 0.020 | 0.08 | 0.0038 | 0.010 | |
| Y | 0.010 | 0.03 | 1.55 | 0.005 | 0.005 | 0.019 | 0.20 | 0.0040 | 0.010 | |

| Steel no. | C × Nb | Molar % of Ti, Nb (, V) bvased carbonitrides (mol %) | C—Nb/ 7.74 | Ti/N | Ceq (%) | Remarks |
|---|---|---|---|---|---|---|
| A | 0.0022 | 0.12 | −0.018 | 5.9 | 0.27 | Inv. |
| B | 0.0063 | 0.31 | 0.003 | 10.7 | 0.29 | ex. |
| C | 0.0020 | 0.10 | −0.030 | 4.2 | 0.23 | |
| D | 0.0024 | 0.12 | −0.021 | 6.8 | 0.23 | |
| E | 0.0056 | 0.21 | −0.016 | 6.8 | 0.29 | |
| F | 0.0025 | 0.13 | −0.022 | 3.3 | 0.27 | |
| G | 0.0060 | 0.29 | 0.004 | 6.7 | 0.39 | |
| H | 0.0010 | 0.12 | −0.003 | 6.7 | 0.25 | |
| I | 0.0004 | 0.09 | −0.001 | 7.4 | 0.40 | |
| J | 0.0040 | 0.21 | −0.006 | 6.5 | 0.29 | |
| K | 0.0013 | 0.07 | −0.027 | 6.9 | 0.51 | |
| L | 0.0027 | 0.13 | −0.025 | 6.8 | 0.25 | |
| M | 0.0011 | 0.12 | −0.004 | 7.9 | 0.47 | |
| N | 0.0023 | 0.09 | −0.053 | 2.4 | 0.07 | |
| O | 0.0025 | 0.12 | −0.022 | 7.3 | 0.28 | |
| P | 0.0033 | 0.16 | −0.013 | 7.4 | 0.27 | |
| Q | 0.0014 | 0.09 | −0.014 | 11.8 | 0.33 | |
| R | 0.0080 | 0.31 | 0.014 | 12.5 | 0.31 | Comp. |
| S | 0.0050 | 0.22 | −0.012 | 4.0 | 0.33 | ex. |
| T | 0.0015 | 0.10 | 0.024 | 5.6 | 0.29 | |
| U | 0.0020 | 0.21 | 0.007 | 5.9 | 0.27 | |
| V | 0.0008 | 0.12 | 0.000 | 1.8 | 0.30 | |
| W | 0.265 | 0.52 | −0.018 | 6.9 | 0.40 | |
| X | 0.0032 | 0.14 | 0.030 | 5.3 | 0.27 | |
| Y | 0.0020 | 0.13 | −0.016 | 4.8 | 0.27 | |

TABLE 2

| | | Production conditions | | | | | Ordinary temperature mechanical properties | |
|---|---|---|---|---|---|---|---|---|
| Production no. | Steel no. | Heating temp. (° C.) | Cumulative reduction rate (%) at 1000° C. or less web/flange | Cooling after rolling | Plate thickness size (mm) H-beam web/flange | Location | Yield point YP (MPa) | Tensile strength TS (MPa) |
| 1 | A | 1300 | 41/36 | Gradual cooling | 13/24 | Flange | 246 | 409 |
| | | | | | | Web | 305 | 448 |
| | | | | | | Fillet | 256 | 415 |
| 2 | B | | 41/38 | | 13/21 | Flange | 355 | 501 |
| | | | | | | Web | 401 | 545 |
| | | | | | | Fillet | 396 | 530 |
| 3 | C | | 35/32 | | 20/35 | Flange | 386 | 513 |
| | | | | | | Web | 406 | 556 |
| | | | | | | Fillet | 379 | 510 |
| 4 | D | | 41/38 | Gradual cooling | 13/21 | Flange | 400 | 521 |
| | | | | | | Web | 426 | 543 |
| | | | | | | Fillet | 385 | 519 |
| 5 | E | | 41/39 | | 11/18 | Flange | 395 | 508 |

TABLE 2-continued

| | | | | | | |
|---|---|---|---|---|---|---|
| | | | | Web | 421 | 528 |
| | | | | Fillet | 385 | 498 |
| 6 | F | 41/36 | 13/24 | Flange | 305 | 476 |
| | | | | Web | 328 | 492 |
| | | | | Fillet | 298 | 458 |
| 7 | G | 41/38 | 13/21 | Flange | 254 | 421 |
| | | | | Web | 278 | 435 |
| | | | | Fillet | 248 | 409 |
| 8 | H | 35/32 | 20/35 | Flange | 295 | 435 |
| | | | | Web | 311 | 450 |
| | | | | Fillet | 288 | 431 |
| 9 | I | 38/34 | 16/28 | Flange | 255 | 405 |
| | | | | Web | 281 | 423 |
| | | | | Fillet | 249 | 402 |
| 10 | J | 35/32 | 20/35 | Flange | 240 | 411 |
| | | | | Web | 272 | 432 |
| | | | | Fillet | 244 | 421 |
| 11 | K | 41/39 | 11/18 | Flange | 371 | 512 |
| | | | | Web | 394 | 536 |
| | | | | Fillet | 369 | 509 |
| 12 | L | 41/36 | 13/24 | Flange | 385 | 552 |
| | | | | Web | 422 | 571 |
| | | | | Fillet | 378 | 550 |

| | Ordinary temperature mechanical properties | | High temperature mechanical properties | | |
|---|---|---|---|---|---|
| | | | 0.2% proof | Simulated | |
| Production no. | Yield ratio (A %) | Charpy absorption energy (J) | stress at 600° C. (MPa) | HAZ reheating embrittlement reduction of area (%) | Remarks |
| 1 | 60 | 261 | 195 | 56 | Inv. |
| | 68 | | 220 | | ex. |
| | 62 | | 184 | | |
| 2 | 71 | 196 | 190 | 31 | |
| | 74 | | 188 | | |
| | 75 | | 195 | | |
| 3 | 75 | 380 | 268 | 78 | |
| | 73 | | 271 | | |
| | 74 | | 272 | | |
| 4 | 77 | 295 | 231 | 65 | |
| | 78 | | 226 | | |
| | 74 | | 238 | | |
| 5 | 78 | 347 | 245 | 52 | |
| | 80 | | 231 | | |
| | 77 | | 239 | | |
| 6 | 64 | 397 | 198 | 64 | |
| | 67 | | 182 | | |
| | 65 | | 195 | | |
| 7 | 60 | 294 | 165 | 43 | |
| | 64 | | 168 | | |
| | 61 | | 170 | | |
| 8 | 68 | 329 | 195 | 53 | |
| | 69 | | 191 | | |
| | 67 | | 199 | | |
| 9 | 63 | 249 | 198 | 52 | |
| | 66 | | 189 | | |
| | 62 | | 197 | | |
| 10 | 58 | 305 | 178 | 59 | |
| | 63 | | 183 | | |
| | 58 | | 199 | | |
| 11 | 72 | 297 | 227 | 78 | |
| | 74 | | 234 | | |
| | 72 | | 241 | | |
| 12 | 70 | 311 | 244 | 66 | |
| | 74 | | 234 | | |
| | 69 | | 256 | | |

TABLE 3

| Production conditions | | | | | | | Ordinary temperature mechanical properties | |
|---|---|---|---|---|---|---|---|---|
| Production no. | Steel no. | Heating temp. (° C.) | Cumulative reduction rate (%) at 1000° C. or less, web/flange | Cooling after rolling | Plate thickness size (mm) H-beam web/flange | Location | Yield point YP (MPa) | Tensile strength TS (MPa) |
| 13 | M | 1300 | 41/39 | Gradual cooling | 11/18 | Flange | 317 | 456 |
| | | | | | | Web | 335 | 475 |
| | | | | Gradual cooling | | Fillet | 301 | 439 |
| 14 | N | | 41/36 | | 13/24 | Flange | 365 | 586 |
| | | | | | | Web | 402 | 590 |
| | | | | | | Fillet | 359 | 565 |
| 15 | O | | 35/32 | | 20/35 | Flange | 397 | 543 |
| | | | | | | Web | 401 | 537 |
| | | | | | | Fillet | 387 | 551 |
| 16 | P | | 43/40 | | 10/16 | Flange | 322 | 457 |
| | | | | | | Web | 356 | 470 |
| | | | | | | Fillet | 350 | 471 |
| 17 | Q | | 38/34 | | 16/28 | Flange | 311 | 421 |
| | | | | | | Web | 315 | 431 |
| | | | | | | Fillet | 309 | 417 |
| 18 | R | 1300 | 35/32 | Gradual cooling | 20/35 | Flange | 374 | 512 |
| | | | | | | Web | 381 | 529 |
| | | | | | | Fillet | 359 | 504 |
| 19 | S | | 41/39 | | 11/18 | Flange | 436 | 598 |
| | | | | | | Web | 461 | 629 |
| | | | | | | Fillet | 440 | 595 |
| 20 | T | | 41/38 | | 13/21 | Flange | 310 | 431 |
| | | | | | | Web | 326 | 449 |
| | | | | | | Fillet | 295 | 421 |
| 21 | U | | 40/35 | | 14/26 | Flange | 366 | 511 |
| | | | | | | Web | 381 | 521 |
| | | | | | | Fillet | 361 | 505 |
| 22 | V | | 40/35 | | 14/26 | Flange | 374 | 536 |
| | | | | | | Web | 391 | 541 |
| | | | | | | Fillet | 364 | 529 |
| 23 | W | | 41/38 | | 13/21 | Flange | 225 | 345 |
| | | | | | | Web | 235 | 350 |
| | | | | | | Fillet | 225 | 331 |
| 24 | X | | 35/32 | | 20/35 | Flange | 278 | 380 |
| | | | | | | Web | 268 | 360 |
| | | | | | | Fillet | 274 | 365 |
| 25 | Y | | 41/36 | | 13/21 | Flange | 236 | 398 |
| | | | | | | Web | 305 | 448 |
| | | | | | | Fillet | 233 | 395 |

| | Ordinary temperature mechanical properties | | High temp. mechanical properties | | |
|---|---|---|---|---|---|
| Production no. | Yield ratio (A %) | Charpy absorption energy (J) | 0.2% proof stress at 600° C. (MPa) | Simulated HAZ reheating embrittlement reduction of area (%) | Remarks |
| 13 | 70 | 184 | 178 | 5 | Inv. ex. |
| | 71 | | 179 | | |
| | 69 | | 183 | | |
| 14 | 62 | 327 | 285 | 71 | |
| | 68 | | 269 | | |
| | 64 | | 291 | | |
| 15 | 73 | 214 | 181 | 63 | |
| | 75 | | 181 | | |
| | 70 | | 189 | | |
| 16 | 70 | 368 | 134 | 56 | |
| | 76 | | 178 | | |
| | 74 | | 130 | | |
| 17 | 74 | 224 | 167 | 67 | |
| | 73 | | 171 | | |
| | 74 | | 164 | | |
| 18 | 73 | 56 | 175 | 29 | Comp. ex. |
| | 72 | | 130 | | |
| | 71 | | 177 | | |
| 19 | 73 | 37 | 228 | 39 | |
| | 73 | | 235 | | |
| | 74 | | 238 | | |

TABLE 3-continued

| | | | | |
|---|---|---|---|---|
| 20 | 72 | 298 | 155 | 35 |
| | 73 | | 151 | |
| | 70 | | 146 | |
| 21 | 72 | 91 | 211 | 38 |
| | 73 | | 208 | |
| | 71 | | 215 | |
| 22 | 70 | 297 | 201 | 58 |
| | 72 | | 210 | |
| | 69 | | 204 | |
| 23 | 65 | 187 | 161 | 8 |
| | 67 | | 166 | |
| | 68 | | 174 | |
| 24 | 73 | 166 | 139 | 36 |
| | 74 | | 144 | |
| | 75 | | 137 | |
| 25 | 59 | 298 | 173 | 87 |
| | 68 | | 165 | |
| | 59 | | 170 | |

Example 2

Steel slabs comprised of the ingredients shown in Steel Nos. A, C, F, and K of Table 1 and made thicknesses of 250 to 300 mm in the same way as Example 1 were hot rolled under the conditions shown in Table 4 to obtain thick-gauge steel plates. Test pieces were taken from the thick-gauge steel plates at the centers of the plate thicknesses and were measured for the tensile properties at ordinary temperature, 0.2% proof stress at 600° C., Charpy absorption energy, and simulated HAZ reheating embrittlement reduction of area under conditions similar to Example 1.

The results are shown in Table 4. The thick-gauge steel plates of Production Nos. 26 and 28 had the target yield point ranges at ordinary temperature of the lower limit value or more of the 400 MPa class of the JIS standard, while the thick-gauge steel plates of Production Nos. 27 and 29 had the target yield point ranges at ordinary temperature of the lower limit value or more of the 490 MPa class of the JIS standard. Further, these had yield ratios (YP/TS) as well satisfying the 0.8 or less low YR value. Furthermore, for the yield point at 600° C. as well, they have tensile strengths at ordinary temperature of 157 MPa or more for the 400 MPa class and 217 MPa or more for the 490 MPa class, have Charpy absorption energies satisfying the reference value of 100 J or more, and sufficiently satisfy the reference for evaluation of the reheating embrittlement resistance of the simulated HAZ reheat reduction of area of 30% or more.

Example 3

Steel slabs comprised of the ingredients shown in Steel Nos. A, D, and J of Table 1 and made thicknesses of 250 to 300 mm in the same way as Example 1 were hot rolled under the conditions shown in Table 5 while changing the cumulative reduction rate at 1000° C. or less to produce H-beams. The other rolling conditions were made similar to Example 1. Further, in the same way as Example 1, the tensile properties at ordinary temperature, the 0.2% proof stress at 600° C., the Charpy absorption energy, and the simulated HAZ reheating embrittlement reduction of area were evaluated.

The results are shown in Table 5. The H-beams of Production Nos. 30, 31, 36, and 37 have target yield point ranges of ordinary temperature of the lower limit value or more of the 400 MPa class of the JIS standard, while the H-beams of Production Nos. 33 and 34 have the target yield point ranges of ordinary temperature of the lower limit value or more of the 490 MPa class of the JIS standard. Further, these had yield ratios (YP/TS) also satisfying the 0.8 or less low YR values. Furthermore, for the yield point at 600° C. as well, they have tensile strengths at ordinary temperature of 157 MPa or more for the 400 MPa class and 217 MPa or more for the 490 MPa class, have Charpy absorption energies satisfying the standard value of 100 J or more, and sufficiently satisfy the standard for evaluation of the reheating embrittlement resistance of a simulated HAZ reheat reduction of area of 30% or more.

TABLE 4

| | | Production conditions | | | | Ordinary temperature mechanical properties | | | | High temperature mechanical properties | | |
|---|---|---|---|---|---|---|---|---|---|---|---|---|
| Production no. | Steel no. | Heating temp. (° C.) | Cumulative reduction rate (%) at 1000° C. or less web/flange | Cooling after rolling | Plate thickness size (mm) | Yield point YP (MPa) | Tensile strength TS (MPa) | Yield ratio (A %) | Charpy absorption energy (J) | 0.2% proof stress at 600° C. (MPa) | Simulated HAZ reheating embrittlement reduction of area (%) | Remarks |
| 26 | A | 1100 | over 30% | Gradual cooling | 25 | 333 | 473 | 70 | 386 | 234 | 61 | Inv. ex. |
| 27 | C | 1150 | over 30% | | 15 | 368 | 534 | 69 | 291 | 241 | 55 | |
| 28 | F | 1150 | over 30% | | 40 | 329 | 457 | 72 | 350 | 220 | 62 | |
| 29 | K | 1200 | over 30% | | 25 | 361 | 529 | 68 | 287 | 231 | 61 | |

On the other hand, the H-beams of Production Nos. 32, 35, and 38 had cumulative reduction rates at 1000° C. or less of less than 30%, so the crystal grains were insufficiently refined in size and the tensile strength at ordinary temperature, 0.2% proof stress at 600° C., and yield point at ordinary temperature fell somewhat as shown by the underlines.

TABLE 5

| Production no. | Steel no. | Cumulative reduction rate at 1000° C. or less (%) | Flange thickness (mm) | Yield point YP (MPa) | Tensile strength TS (MPa) | Yield ratio (%) | Charpy absorption energy (J) | 0.2% proof stress at 600° C. (MPa) |
|---|---|---|---|---|---|---|---|---|
| 30 | A | 36 | 24 | 246 | 409 | 60 | 261 | 195 |
| 31 | | 32 | | 241 | 402 | 60 | 295 | 188 |
| 32 | | 28 | | 233 | 398 | 59 | 325 | 185 |
| 33 | D | 38 | 21 | 400 | 521 | 77 | 295 | 231 |
| 34 | | 33 | | 378 | 512 | 74 | 299 | 223 |
| 35 | | 29 | | 365 | 499 | 73 | 312 | 215 |
| 36 | J | 32 | 35 | 240 | 411 | 58 | 305 | 178 |
| 37 | | 30 | | 237 | 422 | 56 | 298 | 166 |
| 38 | | 25 | | 229 | 421 | 54 | 326 | 156 |

Example 4

Steel slabs comprised of the ingredients shown in Steel Nos. E and J of Table 1 and made thicknesses of 250 to 300 mm in the same way as Example 1 were hot rolled under the conditions shown in Table 6, then acceleratedly cooling while changing the cooling rate from 800° C. to 500° C. to produce H-beams. The accelerated cooling after rolling was performed by water-cooling the outer surfaces of the flanges by a cooling system set at the exit side after finishing rolling at the final rolling mill shown in FIG. 7. The other rolling conditions were made similar to Example 1. Further, in the same way as Example 1, the tensile properties at ordinary temperature, 0.2% proof stress at 600° C., Charpy absorption energy, and simulated HAZ reheating embrittlement reduction of area were evaluated.

The results are shown in Table 6. The H-beams of Production Nos. 42 and 43 have target yield point ranges at ordinary temperature of the lower limit value or more of the 400 MPa class of the JIS standard, while the H-beams of Production Nos. 39 and 40 have target yield point ranges at ordinary temperature of the lower limit value or more of the 490 MPa class of the JIS standard. Further, these have yield ratios (YP/TS) also satisfying the 0.8 or less low YR value. Further, for the yield point at 600° C. as well, they have tensile strengths at ordinary temperature of 157 MPa or more for the 400 MPa class and 217 MPa or more for the 490 MPa class, have Charpy absorption energies satisfying the standard value of 100 J or more, and satisfy the standard for evaluation of the reheating embrittlement resistance of the simulated HAZ reheat reduction of area of 30% or more.

On the other hand, the H-beams of Production Nos. 41 and 44 have cooling rates from 800° C. to 500° C. of less than 0.1° C./s, so the dislocations are repaired and NbC precipitates, so the 0.2% proof stress at 600° C. falls somewhat as shown by the underlines.

TABLE 6

| Production no. | Steel no. | Average cooling rate between 800 to 500° C. (° C./s) | Flange plate thickness (mm) | Yield point YP (MPa) | Tensile strength TS (MPa) | Yield ratio (A %) | Charpy absorption energy (J) | 0.2% proof stress at 600° C. (MPa) |
|---|---|---|---|---|---|---|---|---|
| 39 | E | 6 | 18 | 401 | 510 | 79 | 333 | 231 |
| 40 | | 3 | | 395 | 508 | 78 | 347 | 245 |
| 41 | | 0.05 | | 399 | 498 | 80 | 290 | 216 |
| 42 | J | 5 | 35 | 242 | 408 | 59 | 338 | 162 |
| 43 | | 1 | | 240 | 411 | 58 | 305 | 178 |
| 44 | | 0.05 | | 269 | 418 | 64 | 257 | 153 |

Example 5

In the same way as Example 1, 250 to 300 mm thick steel slabs comprised of the ingredients shown in the Steel Nos. AA to AD of Table 7 were hot rolled under the conditions shown in Table 8 to produce H-beams. Further, in the same way as Example 1, the tensile properties at ordinary temperature, 0.2% proof stress at 600° C., Charpy absorption energy, and simulated HAZ reheating embrittlement reduction of area were evaluated.

The results are shown in Table 8. Production No. 45 is an invention example using Steel No. AA of Table 7 increased in content of Al over Steel No. C of Table 1. Further, Production No. 48 is a comparative example using Steel No. AD increased in content of Al over Steel No. AA of Table 7. If comparing Production No. 3 of Table 2 and Production Nos. 45 and 48 of Table 8, it is learned that an increase in the amount of Al causes the toughness to fall and that if the amount of Al exceeds 0.030%, it falls below even the reference value of 100 J.

Further, Production No. 46 of Table 8 is an invention example selectively adding REM and Ca and has an ordinary temperature yield point range of the lower limit value or more of the 400 MPa class of the JIS standard and has a yield point at 600° C. as well of 157 MPa or more—both satisfying the target values. Production No. 47 is an invention example selectively adding Cr and has an ordinary temperature yield point range of the lower limit value or more of the 490 MPa class of the JIS standard and a yield point at 600° C. as well of 217 MPa or more—both satisfying the target values. Further, Production Nos. 46 and 47 both have a yield ratio (YP/TS) of 0.8 or less, a Charpy absorption energy satisfying the reference value of 100 J or more, and simulated HAZ reheat reduction of area of 30% or more.

TABLE 7

| Steel no. | Chemical ingredients (mass %) C | Si | Mn | P | S | Ti | Nb | N | Al | Others | C × Nb | Molar ratio of Ti, Nb (, V)-based carbonitrides (mol %) | C—Nb/7.74 | Ti/N | Ceq (%) | Remarks |
|---|---|---|---|---|---|---|---|---|---|---|---|---|---|---|---|---|
| AA | 0.007 | 0.10 | 1.50 | 0.004 | 0.005 | 0.018 | 0.29 | 0.0043 | 0.028 | | 0.0020 | 0.10 | −0.030 | 4.2 | 0.28 | Inv. |
| AB | 0.020 | 0.20 | 1.55 | 0.003 | 0.005 | 0.015 | 0.20 | 0.0023 | 0.010 | REM: 0.01, Ca: 0.001 | 0.0040 | 0.22 | −0.006 | 6.5 | 0.29 | ex. |
| AC | 0.010 | 0.14 | 1.52 | 0.006 | 0.006 | 0.014 | 0.22 | 0.0019 | 0.024 | Cr: 0.2 | | 0.12 | −0.018 | 7.4 | 0.31 | |
| AD | 0.007 | 0.10 | 1.50 | 0.004 | 0.005 | 0.018 | 0.29 | 0.0043 | 0.043 | | 0.0020 | 0.10 | −0.030 | 4.2 | 0.28 | Comp. ex. |

TABLE 8

| Production conditions | | | | | | | Ordinary temperature mechanical properties | |
|---|---|---|---|---|---|---|---|---|
| Production no. | Steel no. | Heating temp. (° C.) | Cumulative reduction rate (%) at 1000° C. or less, web/flange | Cooling after rolling | Plate thickness size (mm) H-beam web/flange | Location | Yield point YP (MPa) | Tensile strength TS (MPa) |
| 45 | AA | 1300 | | Gradual cooling | 20/35 | Flange | 401 | 521 |
| | | | | | | Web | 421 | 544 |
| | | | | | | Fillet | 391 | 513 |
| 46 | AB | | | | 20/25 | Flange | 339 | 442 |
| | | | | | | Web | 331 | 434 |
| | | | | | | Fillet | 319 | 429 |
| 47 | AC | | | | 10/16 | Flange | 391 | 510 |
| | | | | | | Web | 380 | 505 |
| | | | | | | Fillet | 387 | 521 |
| 48 | AD | 1300 | 35/32 | Gradual cooling | 20/35 | Flange | 409 | 531 |
| | | | | | | Web | 426 | 570 |
| | | | | | | Fillet | 399 | 522 |

| Production no. | Ordinary temperature mechanical properties: Yield ratio (A %) | Charpy absorption energy (J) | High temperature mechanical properties: 0.2% proof stress at 600° C. (MPa) | Simulated HAZ reheating embrittlement reduction of area (%) | Remarks |
|---|---|---|---|---|---|
| 45 | 77 | 184 | 270 | 73 | Inv. |
| | 77 | | 284 | | ex. |
| | 76 | | 269 | | |
| 46 | 77 | 334 | 201 | 64 | |
| | 76 | | 195 | | |
| | 74 | | 180 | | |
| 47 | 77 | 329 | 229 | 78 | |
| | 75 | | 231 | | |
| | 74 | | 241 | | |
| 48 | 77 | 81 | 281 | 75 | Comp. |
| | 75 | | 296 | | ex. |
| | 76 | | 286 | | |

INDUSTRIAL APPLICABILITY

According to the present invention, it becomes possible to provide a fire resistant steel material having sufficient ordinary temperature strength and high temperature strength and superior in HAZ toughness and reheating embrittlement resistance without cold working and thermal refining treatment. By utilizing the fire resistant steel material of the present invention for structural members of buildings etc., a great reduction in costs will be realized due to the reduction of installation costs and shortening of work periods and an improvement in the reliability of large-sized buildings, safety, and improvement of economy will be achieved.

The invention claimed is:

1. A fire resistant steel material excellent in high temperature strength, toughness, and reheating embrittlement resistance characterized by containing, by mass %, C: 0.001% to 0.030%, Si: 0.05% to 0.50%, Mn: 0.4% to 2.0%, Nb: 0.10% to 0.50%, Ti: 0.005% to less than 0.040%, N: 0.0001% to less than 0.0050%, and Al: 0.005% to 0.030%, limiting P: 0.03% or less and S: 0.02% or less, having contents of C, Nb, Ti, and N satisfying $C—Nb/7.74 \leqq 0$ and $3 \leqq Ti/N \leqq 12$, and having a balance of Fe and unavoidable impurities, and having a cross-sectional shape of an H-shape comprised of integrally formed flanges and a web, said flanges have a plate thickness of 12 mm or more, and said web has a plate thickness of 7 mm or more.

2. A fire resistant steel material excellent in high temperature strength, toughness, and reheating embrittlement resistance as set forth in claim 1, characterized by further containing, by mass %, one or both of V: 0.10% or less and Mo: less than 0.10%.

3. A fire resistant steel material excellent in high temperature strength, toughness, and reheating embrittlement resistance as set forth in any one of claims 1 and 2, characterized by further containing, by mass %, one or both of:

Zr: 0.03% or less and

Hf: 0.010% or less.

4. A fire resistant steel material excellent in high temperature strength, toughness, and reheating embrittlement resistance as set forth in any one of claims 1 and 2, characterized by further containing, by mass %, one or more of Cr: 1.5% or less, Cu: 1.0% or less, and Ni: 1.0% or less.

5. A fire resistant steel material excellent in high temperature strength, toughness, and reheating embrittlement resistance as set forth in any one of claims 1 and 2, characterized by further containing, by mass %, one or more of Mg: 0.005% or less, REM: 0.01% or less, and Ca: 0.005% or less.

6. A fire resistant steel material excellent in high temperature strength, toughness, and reheating embrittlement resistance as set forth in any one of claims 1 and 2, characterized in that an Nb and C mass concentration product, Nb×C, is 0.0015 or more.

7. A fire resistant steel material excellent in high temperature strength, toughness, and reheating embrittlement resistance as set forth in any one of claims 1 and 2, characterized in that an equilibrium precipitation molar ratio of Ti—Nb-based carbonitrides at 600° C. is less than 0.3%.

8. A process for production of a fire resistant steel material excellent in high temperature strength, toughness, and reheating embrittlement resistance characterized by heating a steel slab having the ingredients described in any one of claims 1 and 2 to 1100 to 1350° C. and hot rolling it by a cumulative reduction rate of 30% or more at 1000° C. or less.

9. A process for production of a fire resistant steel material excellent in high temperature strength, toughness, and reheating embrittlement resistance as set forth in claim 8 characterized by cooling in a temperature range of 800° C. to 500° C. after the rolling by an average cooling rate of 0.1 to 10° C./s.

10. A process for production of a fire resistant steel material excellent in high temperature strength, toughness, and reheating embrittlement resistance characterized by heating a steel slab having the ingredients described in any one of claims 1 and 2 to 1100 to 1350° C. and using a universal rolling mill train to hot roll it by a cumulative reduction rate of 30% or more at 1000° C. or less to obtain a steel material having a cross-section shape of an H-shape comprised of integrally formed flanges and a web.

11. A process for production of a fire resistant steel material excellent in high temperature strength, toughness, and reheating embrittlement resistance as set forth in claim 10 characterized by spray cooling the flanges from the outside and cooling in a temperature range of 800° C. to 500° C. of the flanges after the rolling by an average cooling rate of 0.1 to 10° C./s.

12. A fire resistant steel material excellent in high temperature strength, toughness, and reheating embrittlement resistance as set forth in any one of claims 1 and 2, further containing, by mass %, 0.0005% or less of B.

* * * * *